US012638199B2

(12) United States Patent
Kobayashi et al.

(10) Patent No.: US 12,638,199 B2
(45) Date of Patent: May 26, 2026

(54) AIR CONDITIONING SYSTEM

(71) Applicant: Panasonic Intellectual Property Management Co., Ltd., Osaka (JP)

(72) Inventors: Junya Kobayashi, Aichi (JP); Keito Ito, Aichi (JP); Josui Kishimoto, Aichi (JP); Ryosuke Nagata, Saitama (JP); Masahiro Shigemori, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 339 days.

(21) Appl. No.: 18/547,119

(22) PCT Filed: Feb. 24, 2022

(86) PCT No.: PCT/JP2022/007480
§ 371 (c)(1),
(2) Date: Aug. 18, 2023

(87) PCT Pub. No.: WO2022/181658
PCT Pub. Date: Sep. 1, 2022

(65) Prior Publication Data

US 2024/0318846 A1 Sep. 26, 2024

(30) Foreign Application Priority Data

Feb. 26, 2021 (JP) ..... 2021-029471
Feb. 26, 2021 (JP) ..... 2021-029472

(51) Int. Cl.
*F24F 11/00* (2018.01)

(52) U.S. Cl.
CPC ..... *F24F 11/0008* (2013.01)

(58) Field of Classification Search
CPC ..... F24F 2110/20; F24F 2110/12; F24F 2140/00; F24F 11/63; F24F 11/30;
(Continued)

(56) References Cited

U.S. PATENT DOCUMENTS 11,137,160 B2 * 10/2021 Salsbury ..... G05D 23/1904
11,692,722 B2 * 7/2023 Takao ..... F24F 11/0008 62/176.6

(Continued)

FOREIGN PATENT DOCUMENTS

CA 3108793 A1 4/2020
JP H08-028935 A 2/1996

(Continued)

OTHER PUBLICATIONS

International Search Report issued on May 10, 2022 in International Patent Application No. PCT/JP2022/007480, with English translation.

*Primary Examiner* — Joel M Attey
*Assistant Examiner* — Meraj A Shaikh
(74) *Attorney, Agent, or Firm* — Rimon P.C.

(57) ABSTRACT

Air conditioning system includes: air conditioner adjusting temperature of air in room; humidifier humidifying temperature-adjusted air; a plurality of transfer fans transferring air in room to a plurality of habitable rooms; and controller controlling humidifier. Controller acquires information related to detected humidities of air detected in rooms at a predetermined time interval, when the detected humidity is a first humidity, causes the humidifier to execute first humidifying control, and when the detected humidity changes from the first humidity to a second humidity differing from the first humidity, causes the humidifier to switch to and execute a second humidifying control based on the second humidity in a case of a humidity difference between the first humidity and the second humidity being less than or equal to a threshold value, and to continue to execute the first humidifying control in the case of the humidity difference being more than the threshold value.

2 Claims, 17 Drawing Sheets

(58) Field of Classification Search
CPC ..... F24F 11/74; F24F 11/77; F24F 11/0008; F24F 11/62; F24F 11/64; Y02B 30/70
See application file for complete search history.

(56) References Cited

U.S. PATENT DOCUMENTS

| | | | | |
|---|---|---|---|---|
| 2004/0041036 | A1* | 3/2004 | Acker, Jr. | F24F 11/0001 236/44 R |
| 2013/0197678 | A1* | 8/2013 | Ara | G05B 19/02 700/83 |
| 2013/0261807 | A1* | 10/2013 | Zywicki | F24F 11/62 700/278 |
| 2014/0339317 | A1* | 11/2014 | Kobayashi | G01N 17/002 236/44 C |
| 2017/0153033 | A1* | 6/2017 | Yoshimoto | H02S 20/26 |
| 2018/0335236 | A1 | 11/2018 | Kasai et al. | |
| 2020/0041157 | A1* | 2/2020 | Salsbury | F24F 11/65 |
| 2021/0247079 | A1* | 8/2021 | Tsubouchi | F24F 11/77 |
| 2021/0310685 | A1* | 10/2021 | Kanematsu | F24F 11/67 |
| 2025/0012465 | A1* | 1/2025 | Dai | F24F 11/0008 |

FOREIGN PATENT DOCUMENTS

| | | | |
|---|---|---|---|
| JP | 2007-078250 | A | 3/2007 |
| JP | 2009-092360 | A | 4/2009 |
| JP | 2016-166709 | A | 9/2016 |
| JP | 2020-063899 | A | 4/2020 |
| WO | 2017/122265 | A1 | 7/2017 |

* cited by examiner

FIG. 15

| INPUT | | | OUTPUT |
|---|---|---|---|
| INLET TEMPERATURE T | ROTATION SPEED R | TOTAL AIR VOLUME Q | HUMIDIFICATION AMOUNT X |
| T1 | R1 | Q1 | X1 |
| T1 | R1 | Q2 | X2 |
| T1 | R2 | Q1 | X3 |
| T1 | R2 | Q2 | X4 |
| T2 | R1 | Q1 | X5 |
| T2 | R1 | Q2 | X6 |
| T2 | R2 | Q1 | X7 |
| T2 | R2 | Q2 | X8 |

REGRESSION FORMULA $X = a * T + b * R + c * Q$ Formula (1)

$X$: HUMIDIFICATION AMOUNT $R$: ROTATION SPEED $T$: INLET TEMPERATURE $Q$: TOTAL AIR VOLUME $a, b, c$: COEFFICIENTS $\leftrightarrow R = (X' - a * T - c * Q)/b$ Formula (2)

$X'$: REQUIRED HUMIDIFICATION AMOUNT $R$: ROTATION SPEED $T$: INLET TEMPERATURE $Q$: TOTAL AIR VOLUME $a, b, c$: COEFFICIENTS

AIR CONDITIONING SYSTEM

CROSS-REFERENCE OF RELATED APPLICATIONS

This application is the U.S. National Phase under 35 U.S.C. § 371 of International Patent Application No. PCT/JP2022/007480, filed on Feb. 24, 2022, which in turn claims the benefit of Japanese Patent Application No. 2021-029471, filed on Feb. 26, 2021, and Japanese Patent Application No. 2021-029472, filed on Feb. 26, 2021, the entire disclosures of which Applications are incorporated by reference herein.

TECHNICAL FIELD

The present disclosure relates to an air conditioning system capable of air-conditioning a plurality of rooms of a house with one air conditioning machine.

BACKGROUND ART

In the related art, an entire building air conditioning machine has performed air conditioning on a residence. High-heat-insulating and high-airtight residential buildings are predicted to increase along with an increase in demand for energy-saving residential buildings and tightening of regulations, and an air conditioning system suitable for the characteristics thereof is demanded.

As such an air conditioning system, there is known an entire building air conditioning system that conditions air transferred from a plurality of spaces (habitable rooms) or the like to an air conditioning room at a predetermined temperature and humidity in the air conditioning room and then transfers the air to the plurality of spaces or the like so that the temperature and humidity of the air in the plurality of spaces or the like become target temperature and humidity (for example, PTL 1).

CITATION LIST

Patent Literature

PTL 1: Unexamined Japanese Patent Publication No. 2020-63899

SUMMARY OF THE INVENTION

However, a humidifier in a conventional entire building air conditioning system determines whether to execute humidifying operation with reference to a difference value between a target humidity and a current humidity of an air-conditioned space. Therefore, when an instantaneous change in the current absolute humidity of the air-conditioned space due to the influence of the disturbance or the like is detected, the air conditioning system may switch the operation between the humidifying operation and stop action. As a result, the humidifying operation and the stop action may frequently occur alternately, which results in a problem that humidification by the humidifier cannot be stably performed.

An object of the present disclosure is to provide an air conditioning system capable of stably performing humidification by the humidifier even when humidity affected by disturbance is detected in the air-conditioned space.

An air conditioning system according to the present disclosure includes: an air conditioning room configured to introduce air from outside; an air conditioning machine disposed in the air conditioning room and adjusting temperature of the air in the air conditioning room; a humidifier disposed in the air conditioning room and humidifying the air temperature-adjusted by the air conditioning machine; a plurality of transfer fans transferring the air in the air conditioning room to a plurality of air-conditioned spaces independent of the air conditioning room, respectively; and a controller controlling the humidifier and the transfer fans. The controller acquires information related to detected humidity of the air detected in each of the plurality of air-conditioned spaces a plurality of times at a predetermined time interval. When the detected humidity is a first humidity, the controller causes the humidifier to execute a first humidifying control based on the first humidity. When the detected humidity changes from the first humidity to a second humidity differing from the first humidity, the controller causes the humidifier to switch to and execute a second humidifying control based on the second humidity in a case of a first humidity difference between the first humidity and the second humidity being less than or equal to a first threshold value, and the controller causes the humidifier to continue to execute the first humidifying control in the case of the first humidity difference being more than the first threshold value, and as a result, the above structure can achieve the intended object.

According to the present disclosure, it is possible to provide the air conditioning system capable of stably performing humidification by a humidifier even when humidity affected by disturbance is detected in the air-conditioned space.

BRIEF DESCRIPTION OF THE DRAWINGS

FIG. 15 is a diagram illustrating humidification performance data of the humidifier.

DESCRIPTION OF EMBODIMENTS

Figure 1:
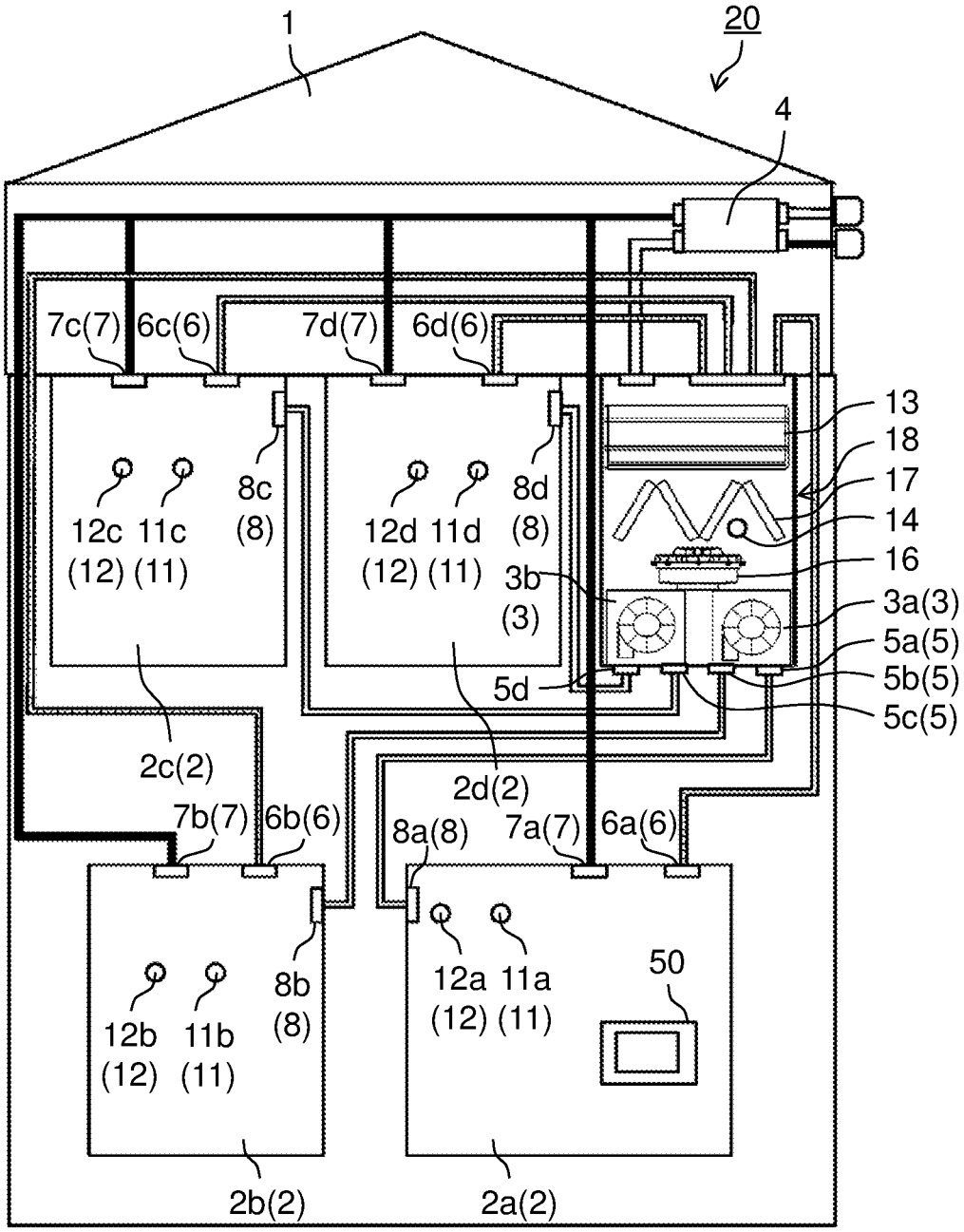
FIG. 1 is a connection schematic diagram of an air conditioning system according to a first exemplary embodiment of the present disclosure.

An air conditioning system according to the present disclosure includes: an air conditioning room configured to introduce air from outside; an air conditioning machine disposed in the air conditioning room and adjusting temperature of the air in the air conditioning room; a humidifier disposed in the air conditioning room and humidifying the air temperature-adjusted by the air conditioning machine; a plurality of transfer fans transferring the air in the air conditioning room to a plurality of air-conditioned spaces independent of the air conditioning room, respectively; and a controller controlling the humidifier and the transfer fans. The controller acquires information related to detected humidity of the air detected in each of the plurality of air-conditioned spaces a plurality of times at a predetermined time interval. When the detected humidity is a first humidity, the controller causes the humidifier to execute a first humidifying control based on the first humidity. When the detected humidity changes from the first humidity to a second humidity differing from the first humidity, the controller causes the humidifier to switch to and execute a second humidifying control based on the second humidity in a case of a first humidity difference between the first humidity and the second humidity being less than or equal to a first threshold value, and the controller causes the humidifier to continue to execute the first humidifying control in the case of the first humidity difference being more than the first threshold value.

According to such configuration, when the first humidity difference exceeds the first threshold value, that is, when the humidity changes rapidly, the humidifying action of the humidifier is executed by the first humidifying control based on the first humidity before the humidity changes to the second humidity. On the other hand, when the first humidity difference is less than or equal to the first threshold value, that is, the humidity does not change rapidly, the humidifying action of the humidifier is executed by the second humidifying control based on the second humidity continuously. Therefore, in the air conditioning system, even when humidity affected by disturbance (detected humidity) is detected in the air-conditioned space, unnecessary operation start or operation stop of the humidifier is not repeated. As a result, humidification by the humidifier can be stably performed.

In addition, in the air conditioning system according to the present disclosure, the controller may cause the humidifier to switch to and execute the second humidifying control instead of the first humidifying control when the first humidity difference is more than the first threshold value and the detected humidity changes from the second humidity to a third humidity differing from the second humidity and in the case of a second humidity difference between the second humidity and the third humidity being less than or equal to a second threshold value.

In this way, even when a humidity change exceeding the first threshold value, that is, a rapid humidity change is detected, when the second humidity difference is less than or equal to the second threshold value, the humidifying action of the humidifier is executed by the second humidifying control. On the other hand, when the second humidity difference exceeds the second threshold value, the humidifying action of the humidifier is executed while continuing the first humidifying control. In other words, when the humidity difference immediately after detection of the rapid humidity change falls below the second threshold value, the humidifying control of the humidifier based on the humidity detected after the rapid humidity change is executed. Therefore, in the air conditioning system, even when the rapid humidity change is detected in a specific air-conditioned space, the humidifying control of the humidity after the change can be executed when such a state continues. As a result, humidification by the humidifier can be stably performed.

Moreover, in the air conditioning system according to the present disclosure, the controller may cause the humidifier to switch to and execute the second humidifying control based on an average value of respective second humidities in the plurality of the air-conditioned spaces in the case of a third humidity difference between the second humidity in one air-conditioned space of the plurality of the air-conditioned spaces and the average value of the respective second humidities in the plurality of the air-conditioned spaces being less than or equal to a third threshold value, and the controller may cause the humidifier to continue to execute the first humidifying control in the case of the third humidity difference being more than the third threshold value.

In this way, when the third humidity difference between the plurality of air-conditioned spaces exceeds the third threshold value, the humidifying action of the humidifier is executed by the first humidifying control based on the average value of the first humidities before the humidity change to the second humidity. On the other hand, when the third humidity difference between the plurality of air-conditioned spaces is less than or equal to the third threshold value, the humidifying action of the humidifier is executed by the second humidifying control based on the average value of the second humidities. Therefore, in the air conditioning system, even when humidity affected by disturbance (detected humidity) is detected in any of the plurality of air-conditioned spaces, unnecessary operation start or operation stop of the humidifier is not repeated. As a result, humidification by the humidifier can be stably performed.

Furthermore, in the air conditioning system according to the present disclosure, the controller may cause the humidifier to switch to and execute the second humidifying control instead of the first humidifying control when the third humidity difference is more than the third threshold value and the detected humidity changes from the second humidity to a fourth humidity differing from the second humidity and in the case of a fourth humidity difference between the second humidity and the fourth humidity being less than or equal to a fourth threshold value.

In this way, even when the third humidity difference between the plurality of air-conditioned spaces exceeds the third threshold value, the humidifying action of the humidifier is executed by the second humidifying control when the fourth humidity difference is less than or equal to the fourth threshold value. Therefore, in the air conditioning system, even when the rapid humidity change is detected in any of the plurality of air-conditioned spaces, the humidifying control of the humidity after the change can be executed when such the state continues, thus humidification by the humidifier can be stably performed.

Hereinafter, exemplary embodiments of the present disclosure will be described with reference to the drawings.

First Exemplary Embodiment

First, air conditioning system 20 according to a first exemplary embodiment will be described with reference to FIG. 1. FIG. 1 is a connection schematic diagram of air conditioning system 20 according to the first exemplary embodiment of the present disclosure.

Air conditioning system 20 is configured by including a plurality of transfer fans 3 (transfer fans 3*a*, 3*b*), heat exchange ventilation fan 4, a plurality of habitable room dampers 5 (habitable room dampers 5*a*, 5*b*, 5*c*, 5*d*), a plurality of circulation ports 6 (circulation ports 6*a*, 6*b*, 6*c*, 6*d*), a plurality of habitable room exhaust ports 7 (habitable room exhaust ports 7*a*, 7*b*, 7*c*, 7*d*), a plurality of habitable room air supply ports 8 (habitable room air supply ports 8*a*, 8*b*, 8*c*, 8*d*), habitable room temperature sensors 11 (habitable room temperature sensors 11*a*, 11*b*, 11*c*, 11*d*), habitable room humidity sensors 12 (habitable room humidity sensors 12*a*, 12*b*, 12*c*, 12*d*), air conditioner (air conditioning machine) 13, inlet temperature sensor 14, humidifier 16, dust collection filter 17, and controller 50 (corresponding to an air conditioning controller).

Air conditioning system 20 is installed in general housing 1 that is an example of a building. General housing 1 includes at least one air conditioning room 18 independent of a plurality of (four in the first exemplary embodiment) habitable rooms 2 (habitable rooms 2*a*, 2*b*, 2*c*, 2*d*) in addition to habitable rooms 2. Here, general housing 1 (housing) is a residence provided as a place where residents live a private life, and as a general configuration, habitable rooms 2 include a living room, a dining room, a bedroom, a private room, a children's room, and the like. The habitable rooms provided with air conditioning system 20 may include a toilet, a bathroom, a washroom, a dressing room, or the like.

Circulation port 6*a*, habitable room exhaust port 7*a*, habitable room air supply port 8*a*, habitable room temperature sensor 11*a*, habitable room humidity sensor 12*a*, controller 50, and an input/output terminal are installed in habitable room 2*a*. Circulation port 6*b*, habitable room exhaust port 7*b*, habitable room air supply port 8*b*, habitable room temperature sensor 11*b*, and habitable room humidity sensor 12*b* are installed in habitable room 2*b*. Circulation port 6*c*, habitable room exhaust port 7*c*, habitable room air supply port 8*c*, habitable room temperature sensor 11*c*, and habitable room humidity sensor 12*c* are installed in habitable room 2*c*. Circulation port 6*d*, habitable room exhaust port 7*d*, habitable room air supply port 8*d*, habitable room temperature sensor 11*d*, and habitable room humidity sensor 12*d* are installed in habitable room 2*d*.

Air conditioning room 18 is provided with transfer fan 3*a*, transfer fan 3*b*, habitable room damper 5*a*, habitable room damper 5*b*, habitable room damper 5*c*, habitable room damper 5*d*, air conditioner 13, inlet temperature sensor 14, humidifier 16, and dust collection filter 17. More specifically, air conditioner 13, dust collection filter 17, inlet temperature sensor 14, humidifier 16, transfer fans 3 (transfer fans 3*a*, 3*b*), and habitable room dampers 5 (habitable room dampers 5*a*, 5*b*, 5*c*, 5*d*) are disposed in this order from the upstream side of the flow path of the air flowing in air conditioning room 18.

Air is introduced into air conditioning room 18 from the outside of air conditioning room 18. Then, the air (indoor air) transferred from each habitable room 2 through circulation port 6 and the outside air (outdoor air) taken in and heat exchanged by heat exchange ventilation fan 4 are mixed in air conditioning room 18. Temperature and humidity of the air in air conditioning room 18 are respectively controlled, that is, respectively conditioned by air conditioner 13 and humidifier 16 provided in air conditioning room 18, so that the air to be transferred to habitable rooms 2 is generated. The air conditioned in air conditioning room 18 is transferred to respective habitable rooms 2 by transfer fans 3. Here, air conditioning room 18 means a space having a certain size in which air conditioner 13, inlet temperature sensor 14, humidifier 16, dust collection filter 17, and the like can be disposed, and the air conditioning of each habitable room 2 can be controlled, but is not intended as a living space, and basically does not mean a room in which a resident stays.

A part of the air in habitable rooms 2 is transferred to air conditioning room 18 through circulation ports 6, and other part of the air is transferred through habitable room exhaust ports 7, heat exchanged by heat exchange ventilation fan 4, and discharged outside. Air conditioning system 20 takes outside air (outdoor air) in while discharging inside air (indoor air) from habitable rooms 2 through heat exchange ventilation fan 4 to perform ventilation with a first-type ventilation method. A ventilation air volume of heat exchange ventilation fan 4 can be set in a plurality of stages, and the ventilation air volume is set so as to satisfy a required ventilation volume defined by laws and regulations.

Heat exchange ventilation fan 4 is configured by including an air supply fan (not illustrated) and an air exhaust fan (not illustrated) therein, and ventilates while exchanging heat between inside air (indoor air) and outside air (outdoor air) by operating the fans. At this time, heat exchange ventilation fan 4 transfers the heat-exchanged outside air to air conditioning room 18.

Transfer fans 3 are provided on a wall surface (a wall surface on the bottom surface side) of air conditioning room 18. The air in air conditioning room 18 is transferred from habitable room air supply ports 8 to habitable rooms 2 through the transfer ducts by transfer fans 3. More specifically, the air in air conditioning room 18 is transferred to each of habitable room 2*a* and habitable room 2*b* located on a first floor of general housing 1 by transfer fan 3*a*, and is transferred to each of habitable room 2*c* and habitable room 2*d* located on a second floor of general housing 1 by transfer fan 3*b*. The transfer ducts connected to habitable room air supply ports 8 of habitable rooms 2 are provided independently of each other.

Habitable room dampers 5 adjust the air blowing volume of air to habitable rooms 2 respectively by adjusting opening degrees of habitable room dampers 5 when transferring air from transfer fans 3 to habitable rooms 2. More specifically, habitable room dampers 5*a*, 5*c* respectively adjust the air blowing volume of air to habitable room 2*a* and habitable room 2*b* located on the first floor. Habitable room dampers 5*b*, 5*d* respectively adjust the air blowing volume of air to habitable room 2*c* and habitable room 2*d* located on the second floor.

A part of the air in habitable rooms 2 (habitable rooms 2*a* to 2*d*) is transferred to air conditioning room 18 through the circulation ducts from corresponding circulation ports 6 (circulation ports 6*a* to 6*d*), respectively. Here, the air transferred through circulation port 6 is naturally transferred to air conditioning room 18 as circulating air by a difference between the volume of air (volume of supply air) transferred from air conditioning room 18 to respective habitable rooms 2 by transfer fans 3 and the volume of air (volume of exhaust air) exhausted outside from habitable room exhaust ports 7 by heat exchange ventilation fan 4. Although the circulation ducts that connect air conditioning room 18 and habitable rooms 2 may be provided independently of each other, a plurality of branch ducts that is a part of the circulation ducts may be joined at the middle to be integrated as one circulation duct, and the one circulation duct may be connected to air conditioning room 18.

As described above, circulation ports 6 (circulation ports 6*a* to 6*d*) are openings for respectively transferring the indoor air from habitable rooms 2 (habitable rooms 2*a* to 2*d*) to air conditioning room 18.

As described above, habitable room exhaust ports 7 (habitable room exhaust ports 7*a* to 7*d*) are openings for respectively transferring indoor air from habitable rooms 2 (habitable rooms 2*a* to 2*d*) to heat exchange ventilation fan 4.

As described above, habitable room air supply ports 8 (habitable room air supply ports 8*a* to 8*d*) are openings for respectively transferring air in air conditioning room 18 from air conditioning room 18 to habitable rooms 2 (habitable rooms 2*a* to 2*d*).

Habitable room temperature sensors 11 (habitable room temperature sensors 11*a* to 11*d*) are sensors that respectively acquire the temperatures (habitable room temperatures) of corresponding habitable rooms 2 (habitable rooms 2*a* to 2*d*), and transmit the temperatures to controller 50.

Habitable room humidity sensors 12 (habitable room humidity sensors 12*a* to 12*d*) are sensors that respectively acquire the humidities (room humidities) of corresponding habitable rooms 2 (habitable rooms 2*a* to 2*d*), and transmit the humidities to controller 50.

Air conditioner 13 corresponds to an air conditioning machine, and controls air conditioning of air conditioning room 18. Air conditioner 13 cools or heats the air in air conditioning room 18 so that the temperature of the air in air conditioning room 18 becomes a set temperature (air conditioning room target temperature). Here, a required amount of heat is calculated from a temperature difference between a target temperature (habitable room target temperature) set by a user and the habitable room temperature, and a temperature based on the calculated result is set to the set temperature. In the first exemplary embodiment, the temperature at least higher than the target temperature is set to the set temperature in order to adjust the temperature of the air in each habitable room 2 to the target temperature more quickly.

Inlet temperature sensor 14 is the sensor that acquires the temperature of air temperature-controlled by air conditioner 13 in air conditioning room 18 and transmits the temperature to controller 50. More specifically, inlet temperature sensor 14 is installed on the downstream side of dust collection filter 17 in air conditioning room 18, acquires the temperature of the air to be sucked into humidifier 16, and transmits the temperature to controller 50.

Humidifier 16 is located downstream of air conditioner 13 (and dust collection filter 17) in air conditioning room 18. When the humidity (habitable room humidity) of the air in each habitable room 2 is lower than the set humidity (habitable room set humidity) set by the user, humidifier 16 humidifies the air in air conditioning room 18 so that the humidity becomes the set humidity. In addition, the humidity in the first exemplary embodiment is indicated by relative humidity, but may be treated as absolute humidity by predetermined conversion processing. In this case, entire handling of the humidities of air conditioning system 20 including the humidity of habitable rooms 2 is preferably handled as the absolute humidities. Details of humidifier 16 will be described later.

Dust collection filter 17 is a dust collection filter that collects particles floating in the air introduced into air conditioning room 18. Dust collection filter 17 collects particles contained in the air transferred into air conditioning room 18 through circulation ports 6, thereby making the air to be supplied indoors by transfer fans 3 clean. Here, dust collection filter 17 is installed so as to obstruct the air flow path in the region between air conditioner 13 and humidifier 16.

Controller 50 is a controller that controls air conditioning system 20 in whole. Controller 50 is connected to be communicable with each of heat exchange ventilation fan 4, transfer fans 3, habitable room dampers 5, habitable room temperature sensors 11, habitable room humidity sensors 12, air conditioner 13, inlet temperature sensor 14, and humidifier 16 by wireless communication.

Controller 50 also controls air conditioner 13 as an air conditioning machine, humidifier 16, the air volumes of transfer fans 3, and the opening degrees of habitable room dampers 5 in accordance with the habitable room temperature and the habitable room humidity of each habitable room 2 respectively acquired by habitable room temperature sensor 11 and habitable room humidity sensor 12, the set temperature (habitable room set temperature) and the set humidity (habitable room set humidity) set for each of habitable rooms 2*a* to 2*d*, and the temperature and the like of the air in air conditioning room 18 acquired by inlet temperature sensor 14. The air volumes of transfer fans 3 may be individually controlled.

As a result, the air conditioned in air conditioning room 18 is transferred to respective habitable rooms 2 with respective air volumes being set by respective transfer fans 3 and respective habitable room dampers 5. Therefore, the habitable room temperature and the habitable room humidity of each habitable room 2 are respectively controlled to be the habitable room set temperature and the habitable room set humidity.

Here, since controller 50 is connected with heat exchange ventilation fan 4, transfer fans 3, habitable room dampers 5, habitable room temperature sensors 11, habitable room humidity sensors 12, air conditioner 13, inlet temperature sensor 14, and humidifier 16 by wireless communication, a complicated wiring construction is eliminated. However, all these devices, or controller 50 and a part of these devices may be configured to be able to communicate by wired communication.

Figure 2:
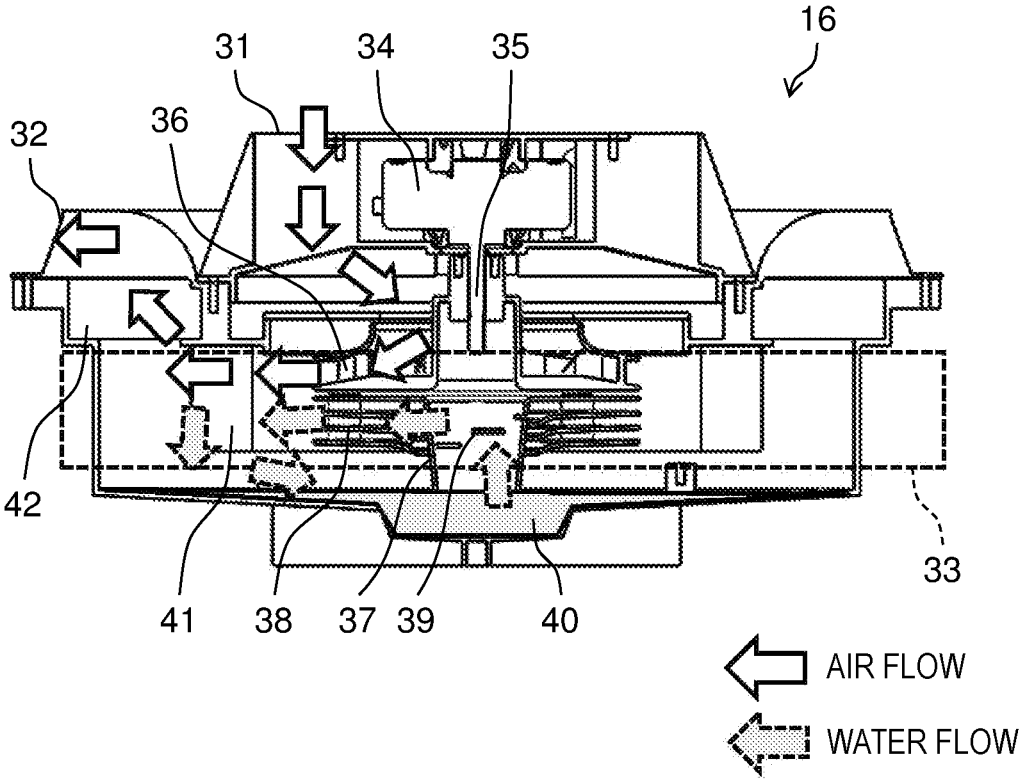
FIG. 2 is a schematic cross-sectional view of a humidifier configuring the air conditioning system.

Next, a configuration of humidifier 16 will be described with reference to FIG. 2. FIG. 2 is a schematic cross-sectional view of humidifier 16 configuring air conditioning system 20.

Humidifier 16 is located downstream of air conditioner 13 in air conditioning room 18, and is a device for humidifying the air in air conditioning room 18 by centrifugal water crushing. In other words, humidifier 16 is a device configured to centrifugally crush and micronize the water pumped by the rotation of water pumping pipe 37, and cause the water to be contained in the air temperature-controlled by air conditioner 13 and to be released.

Humidifier 16 includes inlet 31 for sucking the air in air conditioning room 18, outlet 32 for blowing out humidified air into air conditioning room 18, an air passage provided between inlet 31 and outlet 32, and liquid atomization chamber 33 provided in the air passage.

Inlet 31 is provided on an upper surface of a housing constituting an outer frame of humidifier 16, and outlet 32 is provided on a side surface of the housing. Liquid atomization chamber 33 is a main part of humidifier 16, and performs micronization of water by a centrifugal water crushing method.

Specifically, humidifier 16 includes rotary motor 34, rotary shaft 35 rotated by rotary motor 34, centrifugal fan 36, cylindrical water pumping pipe 37, water storage 40, first eliminator 41, and second eliminator 42.

Water pumping pipe 37 is fixed to rotary shaft 35 inside liquid atomization chamber 33, and pumps up water from a circular pumping port provided vertically downward thereof while rotating in accordance with the rotation of rotary shaft 35. More specifically, water pumping pipe 37 has an inverted conical hollow structure, and includes the circular pumping port vertically downward thereof, and rotary shaft 35 disposed in the vertical direction is fixed to the center of the top surface of the inverted conical shape above water pumping pipe 37. Since rotary shaft 35 is connected to rotary motor 34 positioned vertically above liquid atomization chamber 33, the rotary motion of rotary motor 34 is conducted to water pumping pipe 37 through rotary shaft 35, and water pumping pipe 37 rotates.

Water pumping pipe 37 includes a plurality of rotary plates 38 formed on the top surface side of the inverted conical shape so as to protrude outward from the outer surface of water pumping pipe 37. The plurality of rotary plates 38 are disposed so as to protrude outward from the outer surface of water pumping pipe 37 with predetermined intervals being provided respectively in the axial direction of rotary shaft 35 between rotary plates 38 vertically adjacent to each other. Since rotary plates 38 rotate together with water pumping pipe 37, rotary plates 38 preferably have a horizontal disc shape coaxial with rotary shaft 35. Note that the number of rotary plates 38 may be appropriately set in accordance with target performance or a dimension of water pumping pipe 37.

A wall surface of water pumping pipe 37 is provided with a plurality of openings 39 penetrating the wall surface of water pumping pipe 37. Each of the plurality of openings 39 is provided at a position where the inside of water pumping pipe 37 communicates with the upper surfaces of rotary plates 38 formed so as to protrude outward from the outer surface of water pumping pipe 37.

Centrifugal fan 36 is disposed vertically above water pumping pipe 37, and is a fan for taking air into the device from air conditioning room 18. Centrifugal fan 36 is fixed to rotary shaft 35 like water pumping pipe 37, and rotates in accordance with the rotation of rotary shaft 35 to introduce air into liquid atomization chamber 33.

Water storage 40 stores water to be pumped by water pumping pipe 37 through the pumping port vertically below water pumping pipe 37. Water storage 40 is designed to have a depth in which a part of the lower portion of water pumping pipe 37, for example, a length of about ⅓ to 1/100 of the conical height of water pumping pipe 37 is immersed. This depth can be designed in accordance with a required pumping amount. The bottom surface of water storage 40 is formed as a mortar shape towards the pumping port. Water is supplied to water storage 40 by a water supply portion (not illustrated).

First eliminator 41, which is a porous body through which air can flow, is provided on the side (outer peripheral portion in the centrifugal direction) of liquid atomization chamber 33, and is disposed so that air flows in the centrifugal direction. Water droplets discharged from opening 39 of water pumping pipe 37 collide with first eliminator 41 to be micronized, and first eliminator 41 collects the water droplets out of water contained in the air passing through liquid atomization chamber 33. As a result, the air flowing in humidifier 16 contains vaporized water.

Second eliminator 42 is provided downstream of first eliminator 41, and is disposed so that air flows vertically upward. Second eliminator 42 is also the porous body through which air can flow, and when air passing through second eliminator 42 collides with second eliminator 42, the water droplets of water contained in the air passing through second eliminator 42 are collected. As a result, the micronized water droplets are doubly collected by the two eliminators, thereby colleting water droplets having a large particle size more accurately.

Next, an operation principle of humidification (micronization of water) in humidifier 16 will be described with reference to FIG. 2. In FIG. 2, the air flow and the water flow in humidifier 16 are indicated by arrows.

First, when the operation of humidifier 16 is started, rotary shaft 35 is caused to be rotated at a first rotation speed R1 by rotary motor 34, and the air in air conditioning room 18 is started to be sucked from inlet 31 by centrifugal fan 36. Then, water pumping pipe 37 rotates at the first rotation speed R1 in accordance with the rotation of rotary shaft 35.

Then, in the water flow indicated by dashed arrows in FIG. 2, the water stored in water storage 40 is pumped up by a centrifugal force that is generated by the rotation of water pumping pipe 37. Here, the first rotation speed R1 of rotary motor 11 (water pumping pipe 37) is set, for example, between 600 rpm and 3000 rpm in accordance with an air blowing volume and a humidification amount for air. Since water pumping pipe 37 has the inverted conical hollow structure, water pumped up by rotation is pumped up along the inner wall of water pumping pipe 37. Then, the pumped water is discharged in the centrifugal direction from opening 39 of water pumping pipe 37 along rotary plates 38 and scattered as water droplets.

The water droplets scattered from rotary plates 38 fly in a space (liquid atomization chamber 33) surrounded by first eliminator 41, and collide with first eliminator 41 to be micronized. On the other hand, the air passing through liquid atomization chamber 33 moves to the outer peripheral portion of first eliminator 41 while containing the water crushed (micronized) by first eliminator 41 as in an air flow indicated by solid arrows in FIG. 2. During air flowing in the air passage from first eliminator 41 to second eliminator 42, vortexes of air flow is generated, and water and air are mixed. The air containing water then passes through second eliminator 42. As a result, humidifier 16 can humidify the air sucked from inlet 31 and blow out the humidified air from outlet 32.

Note that the liquid to be micronized may be other than water, and may be, for example, a liquid such as hypochlorous acid water having bactericidal properties or deodorization properties.

Figure 3:
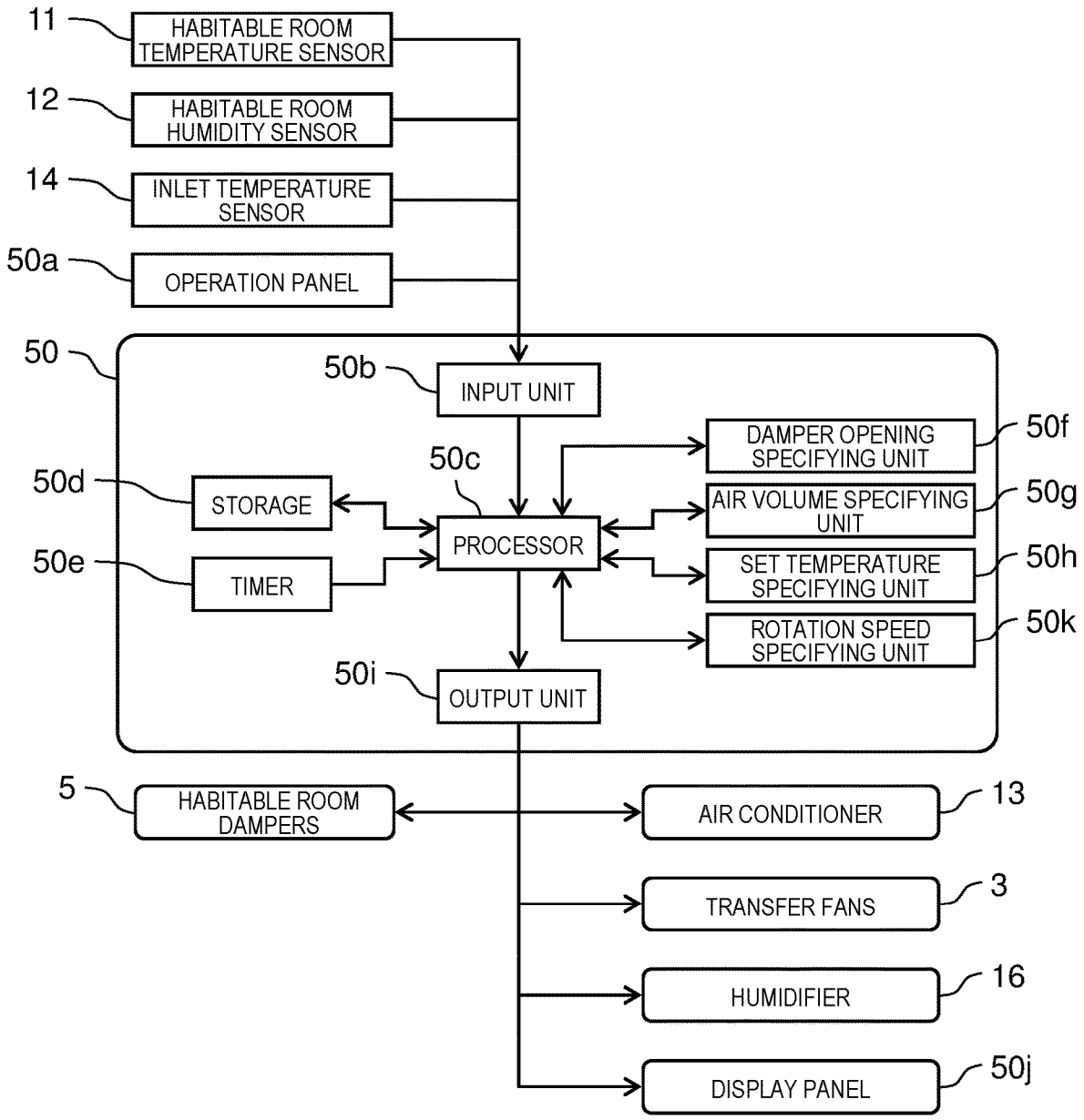
FIG. 3 is a schematic functional block diagram of a system controller of the air conditioning system.

Next, controller 50 in air conditioning system 20 will be described with reference to FIG. 3. FIG. 3 is a schematic functional block diagram of controller 50 in air conditioning system 20.

Controller 50 is installed on a wall surface in a habitable room that is a main living space of general housing 1, such as a living room, and controls operations of air conditioner 13, transfer fans 3, habitable room dampers 5, and humidifier 16. In addition, controller 50 is installed at a height of about a height of human face from the floor of the air-conditioned space in order to facilitate the operation by users. Controller 50 has a rectangular shape, and includes display panel 50*j* in a front central region of the main body and operation panel 50*a* in a right region of the display panel 50*j*.

Display panel 50*j* is a liquid crystal monitor or the like, and displays operation statuses of air conditioner 13, transfer fans 3, habitable room dampers 5, and humidifier 16, and the habitable room set temperatures, the habitable room set humidities, the current habitable room temperatures and the habitable room humidities of habitable rooms 2, and the like on a display screen.

Operation panel 50*a* is a button switch or the like for the user to input the habitable room set temperatures, the habitable room set humidities, and the like for habitable rooms 2.

Controller 50 houses a control unit including a central processing unit (CPU), a memory, and the like of the computer in the main body.

Specifically, the control unit of controller 50 includes input unit 50*b*, processor 50*c*, storage 50*d*, timer 50*e*, damper opening specifying unit 50*f*, air volume specifying unit 50*g*, set temperature specifying unit 50*h*, rotation speed specifying unit 50*k*, and output unit 50*i*.

Input unit 50*b* receives information (first information) on the habitable room temperatures of habitable rooms 2 from habitable room temperature sensors 11, the information (second information) on the room humidities of habitable rooms 2 from habitable room humidity sensors 12, the information (third information) on the inlet temperature of humidifier 16 from inlet temperature sensor 14, and the information (fourth information) on the input setting of the user from the operation panel 50*a*. Input unit 50*b* outputs received the first information to the fourth information to processor 50*c*.

Storage 50*d* stores data to be referred to or updated by processor 50*c*. For example, storage 50*d* stores an algorithm for determining operation modes of air conditioner 13, humidifier 16, and transfer fans 3. In addition, storage 50*d* stores the first information to the fourth information received by input unit 50*b* in time series. Then, storage 50*d* outputs the stored data (memory data) to processor 50*c* in response to a request from processor 50*c*.

Timer 50*e* is used for measuring time as necessary in the program executed by processor 50*c*. Then, timer 50*e* outputs data (time data) indicating the current time to processor 50*c*.

Processor 50*c* receives the first information to the fourth information from input unit 50*b*, the stored data from storage 50*d*, and the time data from timer 50*e*. Processor 50*c* specifies the required air conditioning amount and the required humidification amount required for habitable rooms 2 at regular time intervals (for example, 5 minutes) using each piece of received information.

More specifically, processor 50*c* specifies the required air conditioning amount individually required for each of habitable rooms 2*a* to 2*d* based on the temperature differences between the habitable room set temperatures stored in storage 50*d* and the room temperatures detected by habitable room temperature sensors 11*a* to 11*d* respectively installed in habitable rooms 2*a* to 2*d* at the regular time interval based on the time data acquired from timer 50*e*. In addition, processor 50*c* specifies the required humidification amount individually required for each of habitable rooms 2*a* to 2*d* based on the humidity differences between the habitable room set humidities stored in storage 50*d* and the habitable room humidities detected by habitable room humidity sensors 12*a* to 12*d* respectively installed in habitable rooms 2*a* to 2*d*. In addition, processor 50*c* updates the display of display panel 50*j* via output unit 50*i* according to the change in the information to be displayed on display panel 50*j*.

Damper opening specifying unit 50*f* acquires the information related to the required air conditioning amounts from processor 50*c*, and specifies the opening degrees of habitable room dampers 5*a* to 5*d* based on a ratio of the required air conditioning amount for each of habitable rooms 2*a* to 2*d*. Then, damper opening specifying unit 50*f* outputs the information (opening degree information) related to the specified opening degrees of habitable room dampers 5*a* to 5*d* to processor 50*c*.

Air volume specifying unit 50*g* acquires the information related to the required air conditioning amounts from processor 50*c*, and specifies the blown air volume of air conditioner 13 based on the average value or the total value of the required air conditioning amounts. In addition, air volume deciding unit 50*g* specifies the air blowing volumes of transfer fans 3 (transfer fan 3*a* and transfer fan 3*b*) based on the average value or the total value of the required air conditioning amounts of the first floor and the second floor, respectively. Then, air volume specifying unit 50*g* outputs the information (blown air volume information) related to the specified blown air volume of air conditioner 13 and the information (air blowing volume information) related to the specified air blowing volumes of transfer fans 3 to processor 50*c*.

Set temperature specifying unit 50*h* acquires the information related to the required air conditioning amounts from processor 50*c*, and specifies the set temperature of air conditioner 13 based on the average value or the total value of the required air conditioning amounts. Set temperature specifying unit 50*h* outputs the information (air conditioner set temperature information) related to the specified set temperature of air conditioner 13 to processor 50*c*.

Rotation speed specifying unit 50*k* acquires the information related to the required humidification amounts from processor 50*c* and the information related to inlet temperature of humidifier 16, and specifies the rotation speed of water pumping pipe 37 (rotary motor 34) of humidifier 16. Then, rotation speed specifying unit 50*k* outputs the information (rotation speed information) related to the specified rotation speed of water pumping pipe 37 to processor 50*c*.

Processor 50*c* receives the opening degree information from damper opening specifying unit 50*f*, the blown air volume information and the air blowing volume information from air volume specifying unit 50*g*, the air conditioner set temperature information from set temperature specifying unit 50*h*, and the rotation speed information from rotation speed specifying unit 50*k*. Using the received information, processor 50*c* respectively specifies control information related to the operations of each of air conditioner 13, transfer fans 3 (transfer fan 3*a* and transfer fan 3*b*), habitable room dampers 5 (habitable room dampers 5*a* to 5*d*), and humidifier 16. Then, processor 50*c* outputs the specified control information to output unit 50*i*.

Output unit 50*i* outputs the control information received from processor 50*c* to air conditioner 13, transfer fans 3 (transfer fan 3*a* and transfer fan 3*b*), habitable room dampers 5 (habitable room dampers 5*a* to 5*d*), and humidifier 16, respectively.

Air conditioner 13 executes the air conditioning operation at the air conditioning set temperature and the blown air volume based on the control information in accordance with the control information output from output unit 50*i*. In addition, transfer fans 3 (transfer fan 3*a* and transfer fan 3*b*) execute the air blowing operations at respective air blowing volumes based on the control information according to the control information output from output unit 50*i*. Moreover, the habitable room dampers 5 (habitable room dampers 5*a* to 5*d*) execute the air volume adjustment operations at respective opening degrees based on the control information according to the control information output from output unit 50*i*. Humidifier 16 executes the humidifying action at the rotation speed based on the control information according to the control information output from output unit 50*i*.

As described above, controller 50 causes air conditioner 13, transfer fans 3, habitable room dampers 5, and humidifier 16 to execute their respective operations.

Figure 4:
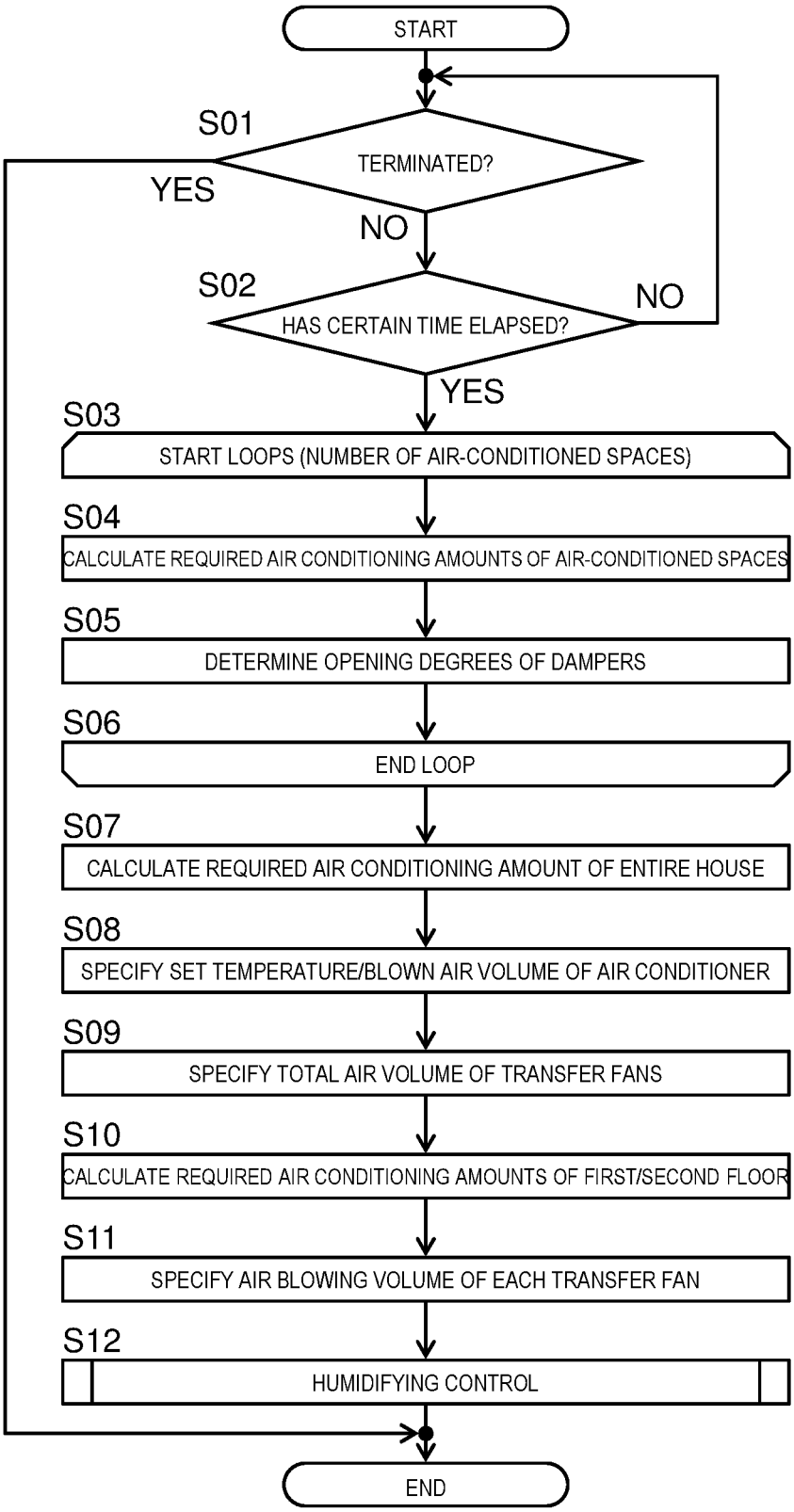
FIG. 4 is a flowchart illustrating a basic processing operation of the controller.

Next, a basic operation of controller 50 will be described with reference to FIG. 4. FIG. 4 is a flowchart illustrating a basic processing operation of controller 50.

First, controller 50 determines termination of air conditioning system 20 (step S01). When the power supply of air conditioning system 20 is turned off (or the operation stop instruction of air conditioning system 20 is input from operation panel 50*a*) (YES in step S01), controller 50 ends the operation of air conditioning system 20. On the other hand, when air conditioning system 20 is powered on (NO in step S01), controller 50 determines whether time has elapsed (step S02). When a certain period of time (for example, 10 minutes) has not elapsed from the previous processing (NO in step S02), controller 50 returns to step S01. On the other hand, when the certain period of time has elapsed since the previous process (YES in step S02), the process proceeds to step S03, and controller 50 performs an output specifying process for habitable room dampers 5, air conditioner 13, and transfer fans 3.

First, controller 50 starts loops corresponding to the number of habitable rooms 2 (step S03). Then, controller 50 calculates required air conditioning amount for each of habitable rooms 2*a* to 2*d* (step S04). In addition, controller 50 specifies the opening degrees of habitable room dampers 5*a* to 5*d* corresponding to habitable rooms 2*a* to 2*d*, respectively (step S05). When the calculation of the required air conditioning amounts of all habitable rooms 2 and the specification of the opening degrees of all habitable room dampers 5 are completed, controller 50 ends the loops (step S06).

The processing in the loop of step S03 to step S06 will be described in more detail using habitable room 2*a* as an example.

In step S04, controller 50 specifies the required air conditioning amount of habitable room 2*a* as a temperature difference between the habitable room temperature acquired from habitable room temperature sensor 11*a* and the habitable room set temperature set for habitable room 2*a*. More specifically, the required air conditioning amount is specified based on a value obtained by subtracting the habitable room temperature from the habitable room set temperature during the heating operation, and is specified based on a value obtained by subtracting the habitable room set temperature from the habitable room temperature during the cooling operation. This means that the larger the required air conditioning amount is at a positive value, the more air conditioning is required for habitable room 2*a*.

In step S05, the opening degree of habitable room damper 5*a* corresponding to habitable room 2*a* is specified in accordance with the required air conditioning amount of habitable room 2*a*. In the first exemplary embodiment, the opening degree is "100%" when the required air conditioning amount is 2° C. or more, the opening degree is "60%" when the required air conditioning amount is 1° C. or more and less than 2° C., the opening degree is "45%" when the required air conditioning amount is 0° C. or more and less than 1° C., the opening degree is "30%" when the required air conditioning amount is −1° C. or more and less than 0° C., and the opening degree is "10%" when the required air conditioning amount is less than −1° C. By setting in this manner, the opening degrees of habitable room dampers 5*a* to 5*d* are set in accordance with the ratio of the required air conditioning amounts of habitable rooms 2*a* to 2*d*, and the more air-conditioned air is blown to the habitable room (habitable room 2) having the higher required air conditioning amount, thus the temperature of each habitable room 2 can be controlled.

Next, controller 50 calculates the required air conditioning amount of entire general housing 1 based on respective required air conditioning amounts of habitable rooms 2 (step S07). In the first exemplary embodiment, the required air conditioning amount of general housing 1 is calculated based on the average value of the required air conditioning amounts of habitable rooms 2.

Subsequently, controller 50 specifies an air conditioning set temperature and a blown air volume of air conditioner 13 in accordance with the calculated required air conditioning amount of general housing 1 (step S08). More specifically, controller 50 sets the air conditioning set temperature higher as the required air conditioning amount is higher during the heating operation, and sets the air conditioning set temperature lower as the required air conditioning amount is higher during the cooling operation. For example, controller 50 sets the air conditioning set temperature to the same value as the habitable room set temperature of habitable room 2 when the required air conditioning amount is less than 0° C., and sets the air conditioning set temperature to be 1° C. higher than the habitable room set temperature of habitable room 2 during the heating operation and 1° C. lower than the habitable room set temperature of habitable room 2 during the cooling operation when the required air conditioning amount is 0° C. or more and less than 1° C. When the required air conditioning amount is 1° C. or more, controller 50 sets the air conditioning set temperature to be higher than the habitable room set temperature of habitable room 2 by 2° C. during the heating operation and lower by 2° C. during the cooling operation. As a result, the higher the required air conditioning amount, the higher the output of air conditioner 13 is operated, and the habitable room temperature of habitable room 2 is controlled to the habitable room set temperature earlier.

Controller 50 controls the blown air volume of air conditioner 13 such that the larger the required air conditioning volume, the larger the blown air volume. In the first exemplary embodiment, the blown air volume is set to 500 $m^3$/h when the required air conditioning amount is less than 0° C., the blown air volume is set to 700 $m^3$/h when the required air conditioning amount is 0° C. or more and less than 1° C., and the blown air volume is set to 1200 $m^3$/h when the required air conditioning amount is 2° C. or more.

Subsequently, controller 50 specifies the total air volume of transfer fans 3 so as to be equal to or slightly larger than the blown air volume of air conditioner 13 (step S09). In other words, controller 50 specifies the air volume difference between the total air volume of transfer fans 3 and the blown air volume of air conditioner 13 to be less than or equal to the reference air volume. As a result, controller 50 suppresses the power consumption of transfer fans 3.

Next, controller 50 calculates respective required air conditioning amounts of the first floor and the second floor (step S10). In the first exemplary embodiment, the average values of the required air conditioning amounts of habitable rooms 2 on each of the first floor and the second floor are set as the required air conditioning amounts of the respective floors.

Subsequently, the air blowing volumes of transfer fans 3 are determined based on the required air conditioning amounts calculated in step S10 (step S11). Controller 50 specifies the air blowing volume of each of transfer fans 3 for the first floor and the second floor so as to set the air volume ratio in accordance with the ratio of the requested air conditioning amounts. Specifically, when the required air conditioning amount of the second floor is 1° C., the required air conditioning amount of the first floor is 2° C., and the total air volume of transfer fans 3 specified in step S09 is 1200 $m^3$/h, controller 50 specifies the air blowing volume of the transfer fan 3*a* for the second floor as 400 $m^3$/h and the air volume of the transfer fan 3*b* for the first floor as 800 $m^3$/h so that the air volume ratio between the transfer fans 3 becomes 1:2. As a result, even when there is the difference in the required air conditioning amounts between the first floor and the second floor, the difference in the air blowing volume by transfer fans 3 causes the difference in the amount of heat to be transferred, thus both the first floor and the second floor can be transferred the amount of heat corresponding to the required air conditioning amounts.

Subsequently, controller 50 starts the humidifying control (step S12).

Figure 5:
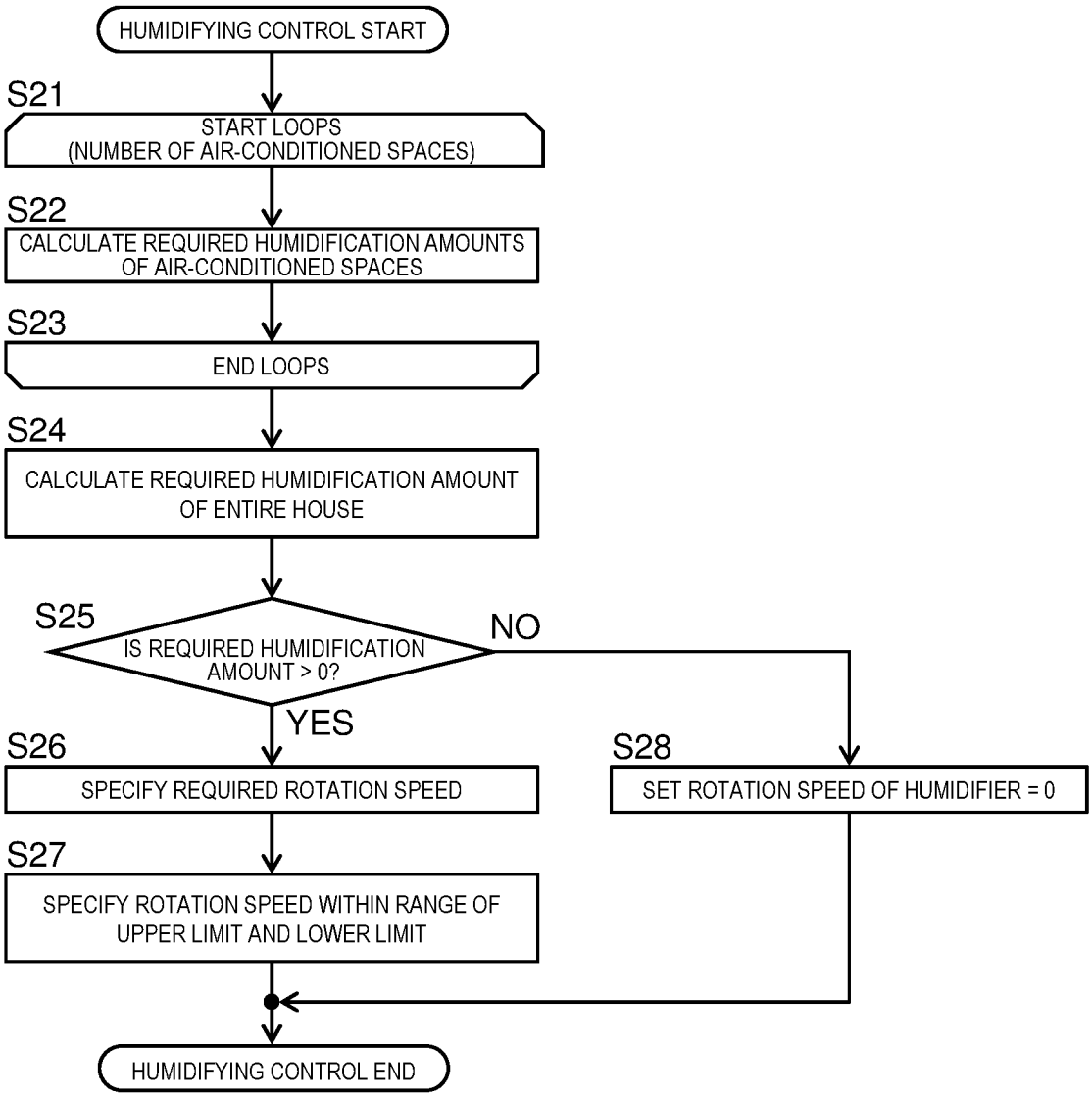
FIG. 5 is a flowchart illustrating a basic processing operation of humidifying control of the controller.

Next, a processing operation of controller 50 when controlling humidifier 16 will be described with reference to FIG. 5. FIG. 5 is a flowchart illustrating a basic processing operation of the humidifying control of controller 50.

<Normal Processing Operation>

When the humidifying control is started, as illustrated in FIG. 5, controller 50 starts loops for the number of habitable rooms 2 which are the air-conditioned spaces (step S21). Then, controller 50 calculates a required humidification amount for each of habitable rooms 2*a* to 2*d* which are the air-conditioned spaces (step S22). When the calculation of the required humidification amounts for all habitable rooms 2 is completed, controller 50 ends the loops (step S23).

The processing in the loop of step S21 to step S23 will be described in more detail using habitable room 2*a* as an example.

In step S22, controller 50 specifies the required humidification amount for habitable room 2*a* as a humidity difference between the room humidity acquired from habitable room humidity sensor 12*a* and the habitable room set humidity set for habitable room 2*a*. Specifically, controller 50 converts each of the habitable room set humidity and the habitable room humidity into the absolute humidity, and sets a value obtained by subtracting the habitable room absolute humidity from the habitable room set absolute humidity as the required humidification amount. This means that the larger the required humidification amount is at a positive value, the more humidification is required for habitable room 2*a*.

Next, controller 50 calculates the required humidification amount of entire general housing 1 based on respective required humidification amounts of habitable rooms 2 (step S24). In the first exemplary embodiment, the required air conditioning amount of general housing 1 is calculated based on the average value of the required humidification amounts of habitable rooms 2.

Next, controller 50 determines the operation of humidifier 16 (step S25). Specifically, when the required humidification amount of general housing 1 is positive (YES in step S25), controller 50 operates humidifier 16 and proceeds to step S26. When the required humidification amount of general housing 1 is 0 or negative (NO in step S25), controller 50 sets the rotation speed of water pumping pipe 37 to "0", does not operate humidifier 16 (step S28), and ends the humidifying control.

Subsequently, controller 50 specifies the required rotation speed of water pumping pipe 37 in accordance with the calculated required air conditioning amount of general housing 1, the inlet temperature of humidifier 16, and the total air volume of transfer fans 3 (step S26). In step S26, controller 50 sets the required rotation speed to be higher as the required humidification amount is higher or the inlet temperature is lower.

In the first exemplary embodiment, controller 50 specifies the required rotation speed based on humidification performance data of humidifier 16. The humidification performance data is data obtained in advance by an experiment, and indicates the humidification amount X output from humidifier 16 when the humidifying action is performed under the conditions of the inlet temperature T of humidifier 16, the rotation speed R of water pumping pipe 37, and the total air volume Q of transfer fans 3. Here, the humidification amount X output by humidifier 16 corresponds to the amount of moisture to be contained in the air flowing through humidifier 16. Regarding the humidification amount X, from the characteristics of humidifier 16, each of the inlet temperature and the rotation speed has a positive correlation with the humidification amount. For example, assuming that the humidification amount at the inlet temperature Ta and the rotation speed Ra is the humidification amount Xa, the humidification amount at the inlet temperature Tb and the rotation speed Rb is the humidification amount Xb, and relationships of the rotation speed Ra<the rotation speed Rb and the temperature Ta=the temperature Tb are satisfied, a magnitude relationship between the humidification amount Xa and the humidification amount Xb is the humidification amount Xa<the humidification amount Xb.

Subsequently, when the required rotation speed exceeds a preset upper limit rotation speed, controller 50 specifies the upper limit rotation speed as the rotation speed of humidifier 16. When the required rotation speed is lower than the preset lower limit rotation speed, controller 50 specifies the lower limit rotation speed as the rotation speed of humidifier 16 (step S27).

<when Disturbance Humidity is Detected>

Figure 6:
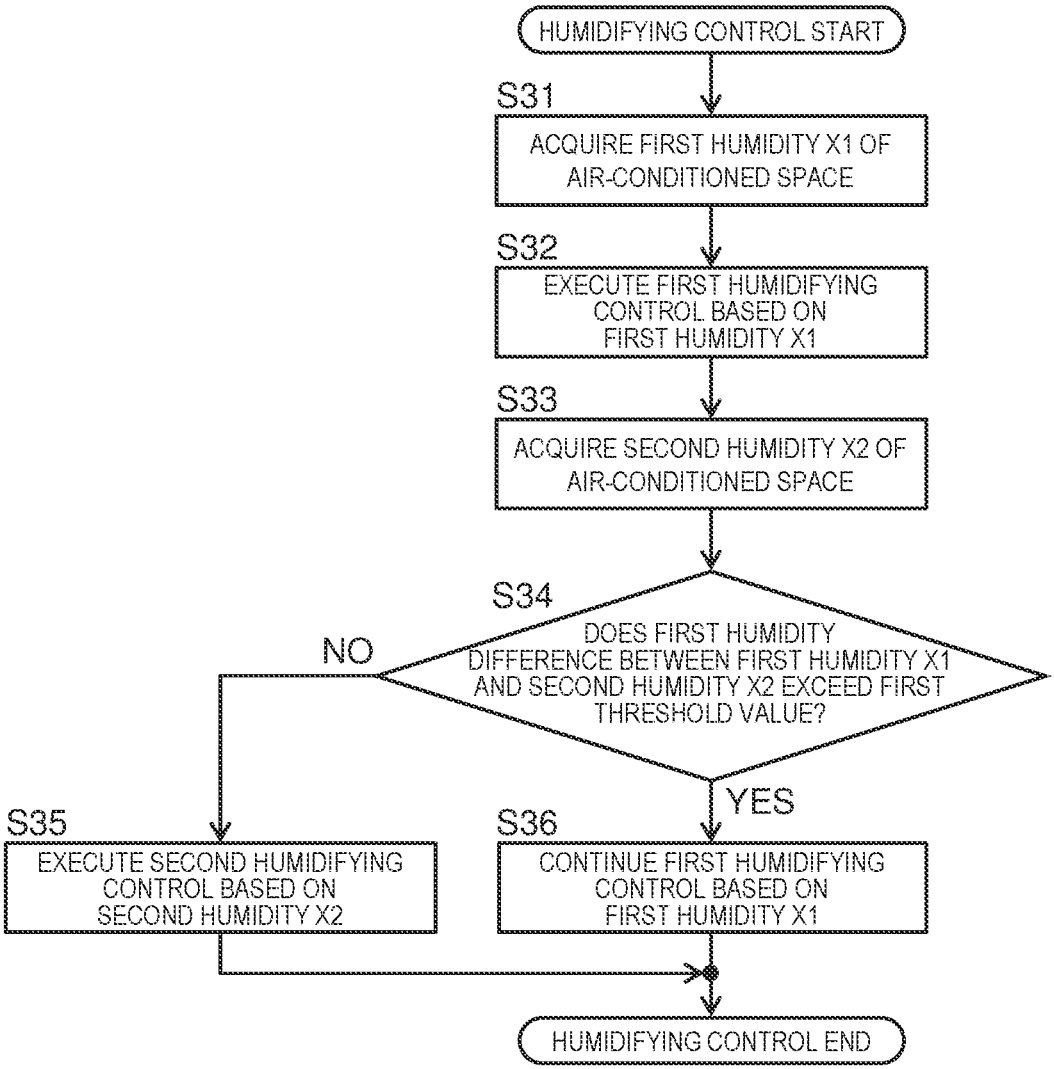
FIG. 6 is a flowchart illustrating a first processing operation of the controller when a humidity change due to disturbance is detected.
Figure 7:
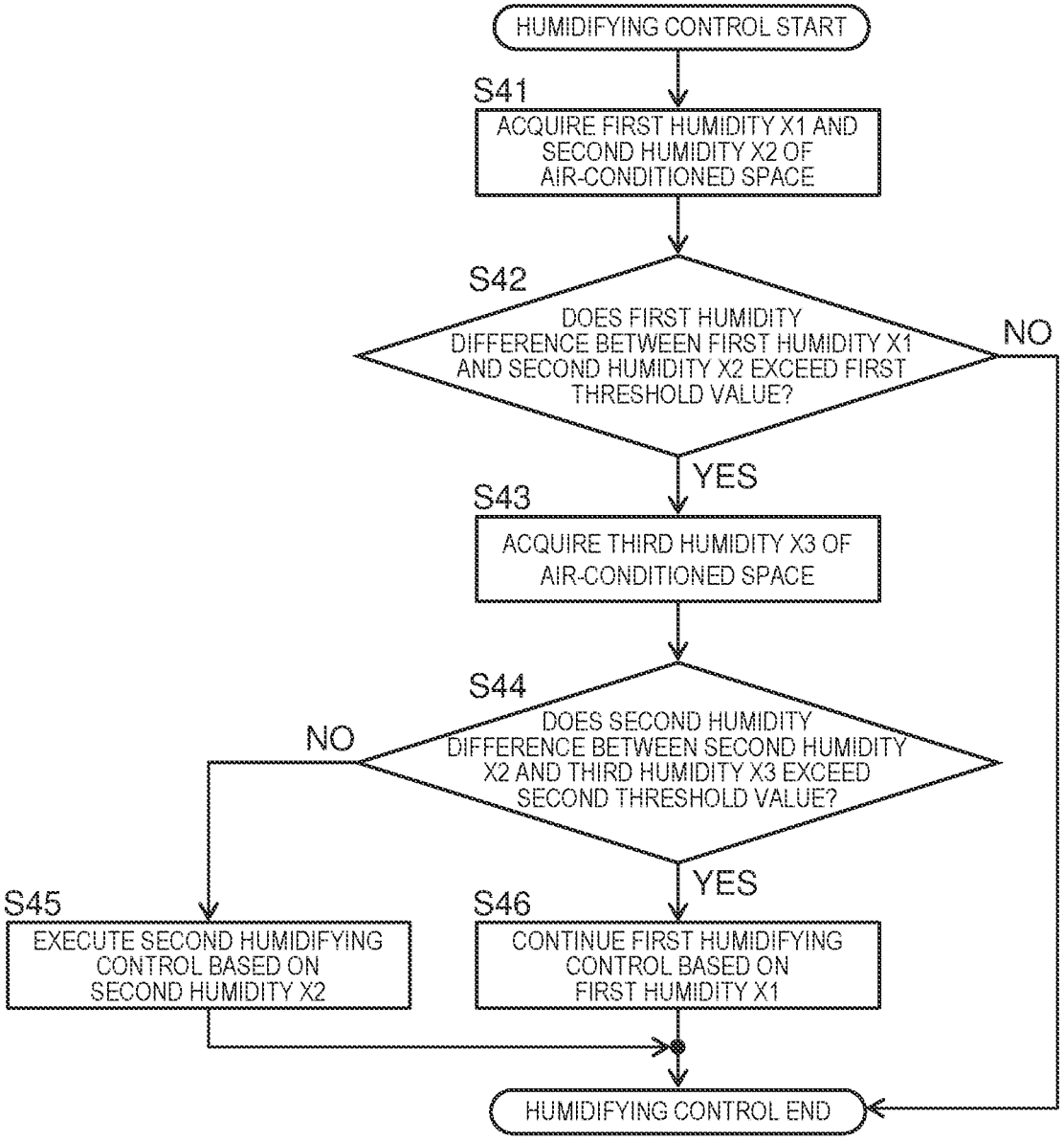
FIG. 7 is a flowchart illustrating a second processing operation of the controller when the humidity change due to disturbance is detected.
Figure 8:
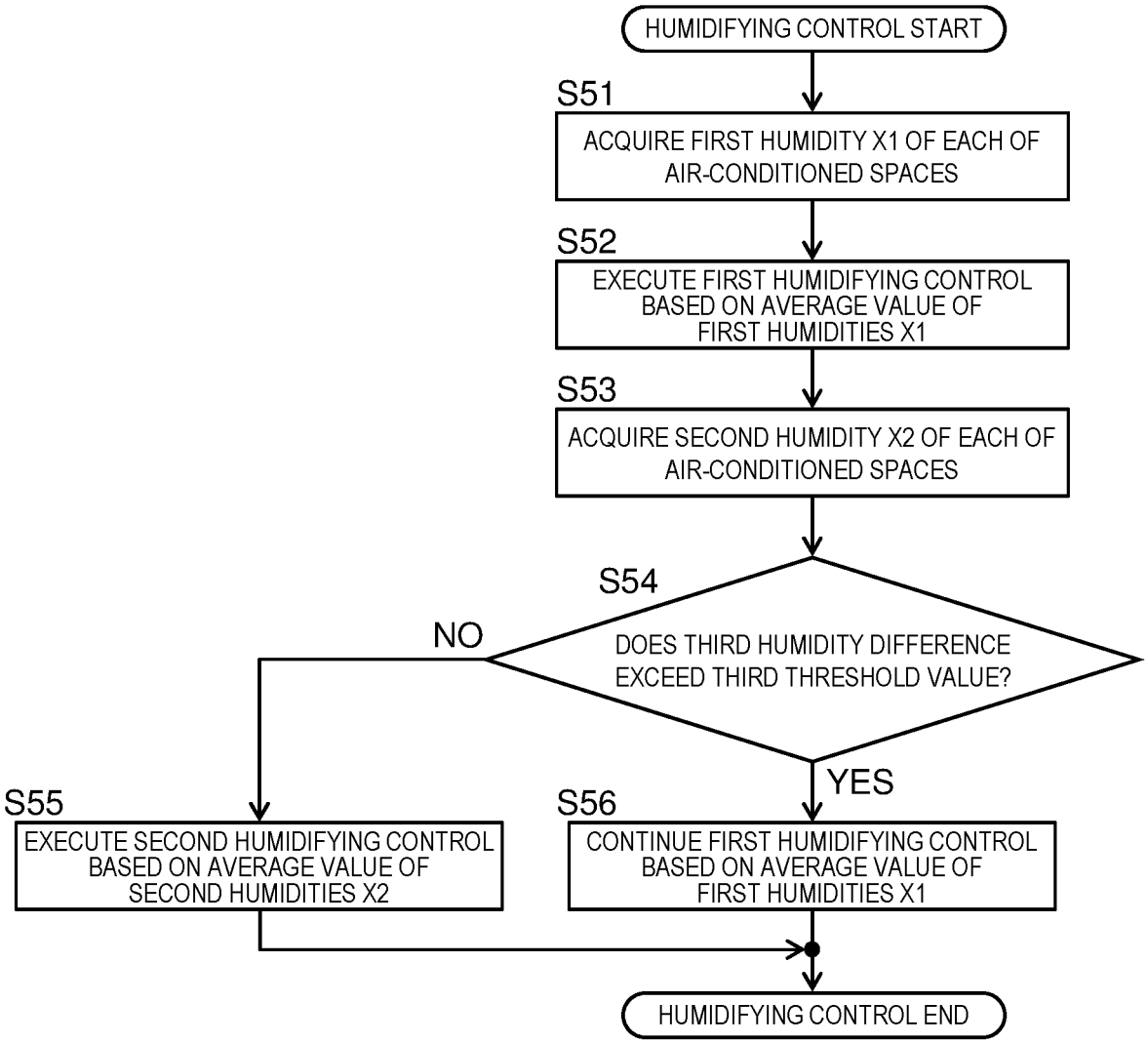
FIG. 8 is a flowchart illustrating a third processing operation of the controller when the humidity change due to disturbance is detected.
Figure 9:
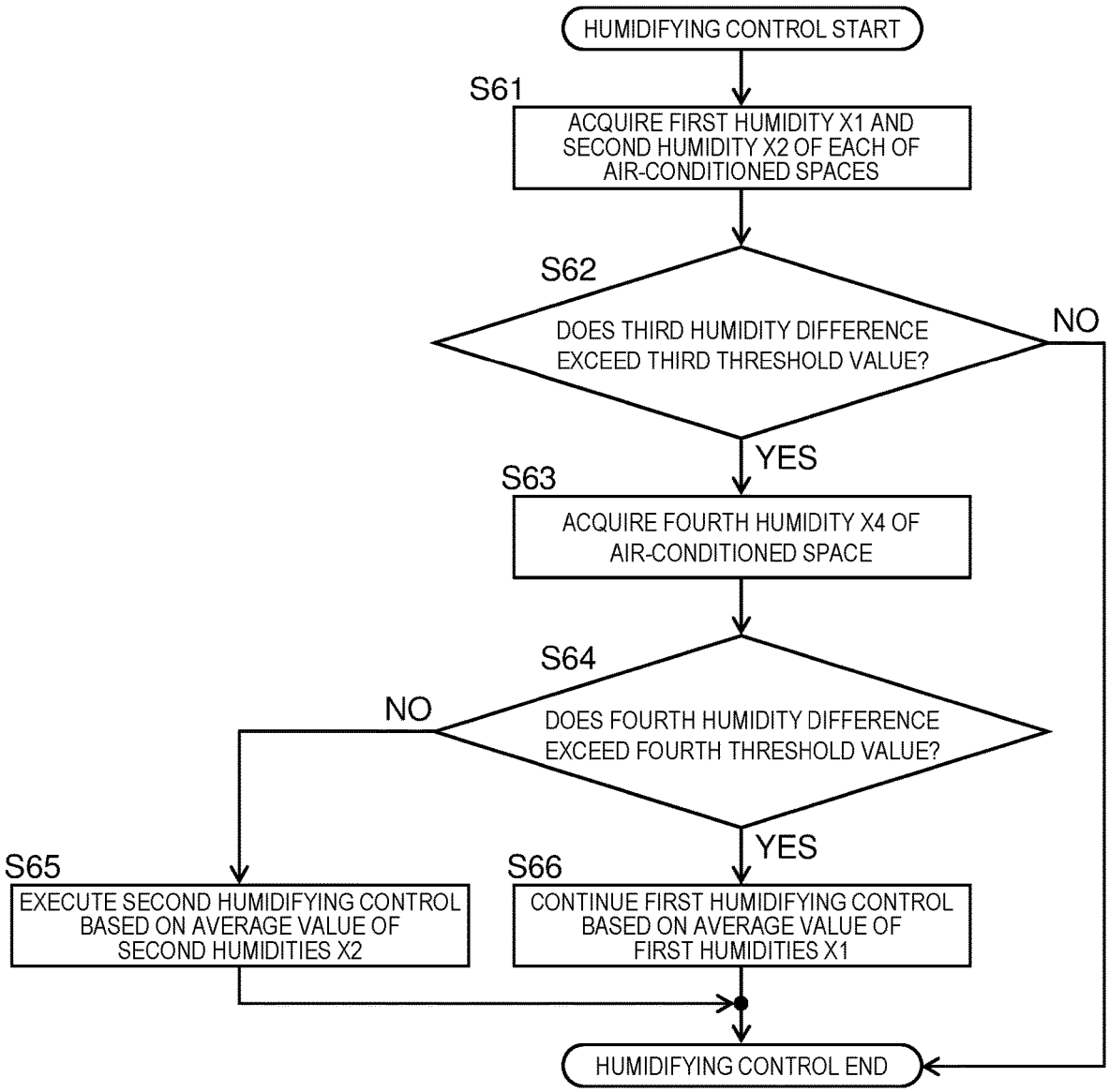
FIG. 9 is a flowchart illustrating a fourth processing operation of the controller when the humidity change due to disturbance is detected.

Next, with reference to FIGS. 6 to 9, the processing operation of controller 50 when a sudden humidity change occurs due to disturbance to habitable room humidity sensors 12*a* to 12*d* will be described. FIG. 6 is a flowchart illustrating a first processing operation of controller 50 when a humidity change due to disturbance is detected. FIG. 7 is a flowchart illustrating a second processing operation of controller 50 when the humidity change due to disturbance is detected. FIG. 8 is a flowchart illustrating a third processing operation of controller 50 when the humidity change due to disturbance is detected. FIG. 9 is a flowchart illustrating a fourth processing operation of controller 50 when the humidity change due to disturbance is detected.

Here, the humidity change due to the disturbance occurs, for example, when habitable room humidity sensors 12*a* to 12*d* are near the doors of habitable rooms 2*a* to 2*d*, and habitable room humidity sensors 12*a* to 12*d* detect the humidity in a state of being affected by the air entering from the hallway due to the temporary opening and closing of the doors.

In the first exemplary embodiment, four processing operations of the first processing operation, the second processing operation, the third processing operation, and the fourth processing operation are executed as the processing operations of controller 50 when a humidity change due to disturbance is detected.

The first processing operation is a series of processing operations executed by determining whether or not the humidity of air (detected humidity) detected by habitable room humidity sensors 12 is affected by disturbance in each of the plurality of habitable rooms 2*a* to 2*d*, and executed based on a result of the determination.

The second processing operation is the series of processing operations executed, regarding one habitable room (for example, habitable room 2*a*) of the plurality of habitable rooms 2, in accordance with a determination as to whether or not the detected humidity detected by habitable room humidity sensor 12*a* significantly deviates from the habitable room set humidity.

The third processing operation is the series of processing operations executed based on a determination as to whether or not the detected humidity detected by at least one habitable room humidity sensor 12*a* of two or more habitable room humidity sensors 12*a* is affected by disturbance in a case where two or more habitable room humidity sensors 12*a* are installed in one habitable room (for example, habitable room 2*a*).

The fourth processing operation is the series of processing operations executed in each of the plurality of habitable rooms 2*a* to 2*d* by determining whether or not the detected humidity detected by habitable room humidity sensors 12*a* to 12*d* greatly deviates from the habitable room set humidity, and executed based on the result of the determination.

<First Processing Operation>

First, the first processing operation will be described with reference to FIG. 6. Here, habitable room 2*a* will be described as an example of habitable rooms 2 that is a target of the processing operation.

In the first processing operation, as illustrated in FIG. 6, controller 50 acquires first humidity X1 as the humidity (detected humidity) of the air detected in habitable room 2*a* from habitable room humidity sensor 12*a* (step S31). It is assumed that first humidity X1 does not include the humidity affected by disturbance. Then, in the basic operation described in FIG. 5, controller 50 specifies the rotation speed of water pumping pipe 37 of humidifier 16 based on first humidity T1, and executes the control of the humidifying action of humidifier 16 as a first humidifying control (step S32).

Then, controller 50 acquires the detected humidity detected in habitable room 2*a* from habitable room humidity sensor 12*a* at a predetermined time interval. Specifically, when the certain period of time (for example, 5 minutes) elapses after first humidity X1 is acquired, controller 50 acquires second humidity X2 as the detected humidity detected in habitable room 2*a* from habitable room humidity sensor 12*a* (step S33).

Next, as a disturbance humidity change determination, controller 50 determines whether or not acquired second humidity X2 is the humidity that has undergone a sudden humidity change under the influence of the disturbance. Specifically, controller 50 determines whether a humidity difference (first humidity difference) between first humidity X1 and second humidity X2 exceeds a first threshold value (step S34). Here, the first threshold value is set to 5%, for example.

Then, as the result of the determination, when the first humidity difference does not exceed the first threshold value, that is, when the first humidity difference is less than or equal to the first threshold value (NO in step S34), controller 50 determines that second humidity X2 does not undergo a rapid change in humidity due to the influence of the disturbance, specifies the rotation speed of water pumping pipe 37 of humidifier 16 based on second humidity X2 in the basic operation described in FIG. 5, and executes the control of the humidifying action of humidifier 16 as a second humidifying control (step S35). That is, when second humidity X2 does not undergo the rapid change due to the influence of the disturbance, controller 50 switches the humidifying action of humidifier 16 from the first humidifying control to the second humidifying control based on second humidity X2 and executes the humidifying action. Then, controller 50 ends the processing operation.

On the other hand, as the result of the determination in step S34, when the first humidity difference exceeds the first threshold value (YES in step S24), controller 50 determines that second humidity X2 is affected by the disturbance and the humidity rapidly changes, and continues to execute the first humidifying control based on first humidity X1 (step S36). That is, when second humidity X2 rapidly changes due to the influence of the disturbance, controller 50 does not switch the humidifying action to the second humidifying control based on second humidity X2, and continuously executes the humidifying action of humidifier 16 while maintaining the first humidifying control. Then, controller 50 ends the processing operation.

Here, the first processing operation described above is executed in all of the plurality of habitable rooms 2. Then, in the disturbance humidity change determination, when controller 50 determines that second humidity X2 is affected by the disturbance and the humidity changes rapidly even in one of the plurality of habitable rooms 2 (for example, habitable room 2*a*), the humidifying control (first humidifying control) linked to habitable room 2*a* is executed even in remaining habitable rooms 2*b* to 2*d* regardless of the determination results in habitable rooms 2*b* to 2*d*.

<Second Processing Operation>

Next, the second processing operation will be described with reference to FIG. 7. Here, habitable room 2*a* will be described as an example of habitable rooms 2 that is a target of the processing operation.

In the second processing operation, as illustrated in FIG. 7, controller 50 acquires first humidity X1 as the humidity (detected humidity) of the air detected in habitable room 2*a* from habitable room humidity sensor 12*a*. It is assumed that first humidity X1 does not include the humidity affected by disturbance. Then, controller 50 acquires the detected humidity detected in habitable room 2*a* from habitable room humidity sensor 12*a* at a predetermined time interval. Specifically, when the certain period of time (for example, 5 minutes) elapses after first humidity X1 is acquired, controller 50 acquires second humidity X2 as the detected humidity detected in habitable room 2*a* from habitable room humidity sensor 12*a* (step S41).

Next, controller 50 determines whether or not acquired second humidity X2 is the humidity that has rapidly changed due to the influence of the disturbance. Specifically, controller 50 determines whether the humidity difference (first humidity difference) between first humidity X1 and second humidity X2 exceeds the first threshold value (step S42). Here, the first threshold value is set to 5%, for example.

Then, as the result of the determination, when the first humidity difference does not exceed the first threshold value, that is, when the first humidity difference is less than or equal to the first threshold value (NO in step S42), controller 50 ends the processing operation without executing anything. On the other hand, in a case where the first humidity difference exceeds the first threshold value (YES in step S42), controller 50 acquires third humidity X3 as the detected humidity detected in habitable room 2*a* from habitable room humidity sensor 12*a* when the certain period of time (for example, 1 minute) has elapsed since the acquisition of second humidity X2 (step S43).

Next, controller 50 determines whether acquired second humidity X2 and third humidity X3 are the humidities normally detected as the actual humidity of habitable room 2*a*. Specifically, controller 50 determines whether the humidity difference (second humidity difference) between second humidity X2 and third humidity X3 is less than or equal to a second threshold value (step S44). Here, the second threshold value is set to 1%, for example.

Then, as the result of the determination, when the second humidity difference does not exceed the second threshold value, that is, when the second humidity difference is less than or equal to the second threshold value (NO in step S44), controller 50 determines that second humidity X2 and third humidity X3 are the humidities normally detected as the actual humidity of habitable room 2*a*, specifies the rotation speed of water pumping pipe 37 of humidifier 16 based on second humidity X2 in the basic operation described in FIG. 5, and executes the control of the humidifying action of humidifier 16 as the second humidifying control (step S45). That is, when second humidity X2 and third humidity X3 of habitable room 2*a* are the humidities normally detected as the actual humidity of habitable room 2*a*, controller 50 executes the humidifying action of humidifier 16 by switching the humidifying action from the first humidifying control to the second humidifying control based on second humidity X2. Then, controller 50 ends the processing operation.

On the other hand, as the result of the determination in step S44, when the second humidity difference exceeds the second threshold value (YES in step S44), controller 50 determines that second humidity X2 has been affected by disturbance and the humidity has temporarily changed, and continues to execute the first humidifying control based on first humidity X1 (step S46). That is, when second humidity X2 is temporarily changed due to the influence of the disturbance, controller 50 does not switch the humidifying action to the second humidifying control based on second humidity X2, and continuously executes the humidifying action of humidifier 16 while maintaining the first humidifying control. Then, controller 50 ends the processing operation.

Here, the second processing operation described above is executed in all of the plurality of habitable rooms 2. Then, in the disturbance humidity change determination, when controller 50 determines that second humidity X2 and third humidity X3 are the humidities normally detected as the actual humidity of habitable room 2*a* even in one (habitable room 2*a* as an example) of the plurality of habitable rooms 2, the humidifying control (second humidifying control) linked with habitable room 2*a* is executed in the remaining habitable rooms 2*b* to 2*d* regardless of the determination results in habitable rooms 2*b* to 2*d*.

<Third Processing Operation>

Next, the third processing operation will be described with reference to FIG. 8. Here, among the plurality of habitable rooms 2, habitable room 2*a* will be described as a space affected by the disturbance.

In the third processing operation, as illustrated in FIG. 8, controller 50 acquires first humidity X1 as the humidity (detected humidity) of the air detected in habitable room 2 from habitable room humidity sensor 12 of each of the plurality of habitable rooms 2 (step S51). It is assumed that first humidity X1 does not include the humidity affected by disturbance. Then, in the basic operation described in FIG. 5, controller 50 specifies the rotation speed of water pumping pipe 37 of humidifier 16 based on an average value of first humidity X1 of each habitable room 2, and executes the control of the humidifying action of humidifier 16 as the first humidifying control (step S52).

Then, controller 50 acquires the detected humidity detected in each of habitable rooms 2 from habitable room humidity sensor 12 at the predetermined time intervals. Specifically, when the certain period of time (for example, 5 minutes) elapses after first humidity X1 is acquired, controller 50 acquires second humidity X2 as the detected humidity detected in each of habitable rooms 2 from habitable room humidity sensor 12 (step S53).

Next, as the disturbance humidity change determination, controller 50 determines whether or not acquired second humidity X2 of habitable room 2*a* is humidity that has undergone a sudden humidity change under the influence of the disturbance. Specifically, controller 50 determines whether the humidity difference (third humidity difference) between the average value of second humidity X2 of each of the plurality of habitable rooms 2 and second humidity X2 of habitable room 2*a* exceeds a third threshold value (step S54). Here, the third threshold value is set to 5%, for example.

Then, as the result of the determination, when the third humidity difference does not exceed the third threshold value, that is, when the third humidity difference is less than or equal to the third threshold value (NO in step S54), controller 50 determines that second humidity X2 of habitable room 2*a* does not undergo rapid change due to the influence of the disturbance, specifies the rotation speed of water pumping pipe 37 of humidifier 16 based on the average value of second humidity X2 in each of the plurality of habitable rooms 2 in the basic operation described in FIG. 5, and executes the control of the humidifying action of humidifier 16 as the second humidifying control (step S55). That is, when second humidity X2 of habitable room 2*a* does not undergo rapid change due to the influence of the disturbance, controller 50 switches the humidifying action of humidifier 16 from the first humidifying control to the second humidifying control based on second humidity X2 and executes the humidifying action. Then, controller 50 ends the processing operation.

On the other hand, when the third humidity difference exceeds the third threshold value as the result of the determination in step S54 (YES in step S54), controller 50 determines that second humidity X2 in habitable room 2*a* is affected by the disturbance and the humidity changes suddenly, and continues to execute the first humidifying control based on the average value of first humidity X1 (step S56). That is, when second humidity X2 of habitable room 2*a* rapidly changes due to the influence of the disturbance, controller 50 continues the humidifying action of humidifier 16 without switching the humidifying action to the second humidifying control based on the average value of second humidity X2 while maintaining the first humidifying control. Then, controller 50 ends the processing operation.

Here, the third processing operation described above is also executed for habitable rooms 2*b* to 2*d*. Then, in the disturbance humidity change determination, when controller 50 determines that second humidity X2 of habitable room 2*a* is affected by the disturbance and the humidity changes rapidly even in one of the plurality of habitable rooms 2 (for example, habitable room 2*a*), the humidifying control (first humidifying control) linked to habitable room 2*a* is executed even in remaining habitable rooms 2*b* to 2*d* regardless of the determination results in habitable rooms 2*b* to 2*d*.

<Fourth Processing Operation>

Next, the fourth processing operation will be described with reference to FIG. 9. Here, among the plurality of habitable rooms 2, habitable room 2*a* will be described as a space affected by the disturbance.

In the fourth processing operation, as illustrated in FIG. 9, controller 50 acquires the first humidity X1 as the humidity (detected humidity) of the air detected in habitable room 2 from habitable room humidity sensor 12 of each of the plurality of habitable rooms 2. It is assumed that first humidity X1 does not include the humidity affected by disturbance. Then, controller 50 acquires the detected humidity detected in each of habitable rooms 2 from habitable room humidity sensor 12 at the predetermined time intervals. Specifically, when the certain period of time (for example, 5 minutes) elapses after first humidity X1 is acquired, controller 50 acquires second humidity X2 as the detected humidity detected in each of habitable rooms 2 from habitable room humidity sensor 12 (step S61).

Next, as the disturbance humidity change determination, controller 50 determines whether or not acquired second humidity X2 of habitable room 2*a* is humidity that has undergone a sudden humidity change under the influence of the disturbance. Specifically, controller 50 determines whether the humidity difference (third humidity difference) between the average value of second humidity X2 of each of the plurality of habitable rooms 2 and second humidity X2 of habitable room 2*a* exceeds the third threshold value (step S62). Here, the third threshold value is set to 5%, for example.

Then, as the result of the determination, when the third humidity difference does not exceed the third threshold value, that is, when the third humidity difference is less than or equal to the third threshold value (NO in step S62), the processing operation is ended without executing anything. On the other hand, in a case where the third humidity difference exceeds the third threshold value (YES in step S62), controller 50 acquires fourth humidity X4 as the detected humidity detected in habitable room 2*a* from habitable room humidity sensor 12*a* when the certain period of time (for example, 1 minute) has elapsed since the acquisition of second humidity X2 (step S63).

Next, controller 50 determines whether acquired second humidity X2 and fourth humidity X4 are the humidities normally detected as the actual humidity of habitable room 2*a*. Specifically, controller 50 determines whether the humidity difference (fourth humidity difference) between second humidity X and fourth humidity X2 is less than or equal to the fourth threshold value (step S64). Here, the second threshold value is set to 1%, for example.

Then, as the result of the determination, when the fourth humidity difference does not exceed the fourth threshold value, that is, when the fourth humidity difference is less than or equal to the fourth threshold value (NO in step S64), controller 50 determines that second humidity X2 and fourth humidity X4 are the humidities normally detected as the actual humidity of habitable room 2*a*, specifies the rotation speed of water pumping pipe 37 of humidifier 16 based on second humidity X2 in the basic operation described in FIG. 5, and executes the control of the humidifying action of humidifier 16 as the second humidifying control (step S65). That is, when second humidity X2 and fourth humidity X4 of habitable room 2*a* are the humidities normally detected as the actual humidity of habitable room 2*a*, controller 50 executes the humidifying action of humidifier 16 by switching the humidifying action from the first humidifying control to the second humidifying control based on second humidity X2. Then, controller 50 ends the processing operation.

On the other hand, as the result of the determination in step S64, when the fourth humidity difference exceeds the fourth threshold value (YES in step S64), controller 50 determines that second humidity X2 has been affected by disturbance and the humidity has temporarily changed, and continues to execute the first humidifying control based on first humidity X1 (step S66). That is, when second humidity X2 is temporarily changed due to the influence of the disturbance, controller 50 does not switch the humidifying action to the second humidifying control based on second humidity X2, and continuously executes the humidifying action of humidifier 16 while maintaining the first humidifying control. Then, controller 50 ends the processing operation.

Here, the fourth processing operation described above is also executed for habitable rooms 2*b* to 2*d*. Then, in the disturbance humidity change determination, when controller 50 determines that second humidity X2 and fourth humidity X4 are the humidities normally detected as the actual humidity of habitable room 2*a* even in one (habitable room 2*a* as an example) of the plurality of habitable rooms 2, the humidifying control (second humidifying control) linked with habitable room 2*a* is executed in remaining habitable rooms 2*b* to 2*d* regardless of the determination results in habitable rooms 2*b* to 2*d*.

Air conditioning system 20 according to the first exemplary embodiment described above can produce the following effects.

(1) Air conditioning system 20 includes: air conditioning room 18 configured to introduce air from outside; air conditioner 13 disposed in air conditioning room 18 and adjusting temperature of air in air conditioning room 18; humidifier 16 disposed in air conditioning room 18 and humidifying air temperature-adjusted by air conditioner 13; a plurality of transfer fans 3 transferring air in air conditioning room 18 to a plurality of habitable rooms 2 independent of air conditioning room 18; and controller 50 controlling humidifier 16 and transfer fans 3. Controller 50 acquires information related to detected humidities of air detected in habitable rooms 2 at a predetermined time interval. When the detected humidity is a first humidity, controller 50 causes humidifier 16 to execute a first humidifying control based on the first humidity. When the detected humidity changes from the first humidity to a second humidity differing from the first humidity, controller 50 causes the humidifier to switch to and execute a second humidifying control based on the second humidity in a case of a first humidity difference between the first humidity and the second humidity being less than or equal to a first threshold value, or the controller 50 causes the humidifier to continue to execute the first humidifying control in the case of the first humidity difference being more than the first threshold value.

In this way, when the first humidity difference exceeds the first threshold value, that is, when the humidity changes rapidly, the humidifying action of humidifier 16 is executed by the first humidifying control based on the first humidity executed before the humidity changes to the second humidity. On the other hand, when the first humidity difference is less than or equal to the first threshold value, that is, the humidity does not change rapidly, the humidifying action of humidifier 16 is executed by the second humidifying control based on the second humidity continuously. Therefore, in air conditioning system 20, even when humidity affected by disturbance (detected humidity) is detected in habitable room 2, unnecessary operation start or operation stop of humidifier 16 is not repeated. As a result, humidification by humidifier 16 can be stably performed.

(2) In air conditioning system 20, controller 50 causes humidifier 16 to switch to and execute the second humidifying control instead of the first humidifying control when the first humidity difference is more than the first threshold value and the detected humidity changes from the second humidity to a third humidity differing from the second humidity and in the case of a second humidity difference between the second humidity and the third humidity being less than or equal to a second threshold value.

In this way, even when a humidity change exceeding the first threshold value, that is, a rapid humidity change is detected, when the second humidity difference is less than or equal to the second threshold value, the humidifying action of humidifier 16 is executed by a third humidifying control. On the other hand, when the second humidity difference exceeds the second threshold value, the humidifying action of humidifier 16 is executed while continuing the first humidifying control. In other words, when the humidity difference immediately after detection of the rapid humidity change falls below the second threshold value, the humidifying control of the humidifier based on the humidity detected after the rapid humidity change is executed. Therefore, in air conditioning system 20, even when the rapid humidity change is detected in a specific air-conditioned space, the humidifying control of the humidity after the change can be executed when such a state continues. As a result, humidification by humidifier 16 can be stably performed.

(3) In air conditioning system 20, controller 50 causes humidifier 16 to switch to and execute the second humidifying control based on an average value of the respective second humidities in the plurality of habitable rooms 2 in the case of a third humidity difference between the second humidity in one habitable room 2*a* of the plurality of habitable rooms 2 and the average value of the respective second humidities in the plurality of habitable rooms 2 being less than or equal to a third threshold value, or the controller 50 causes humidifier 16 to continue to execute the first humidity control in the case of the second humidity difference being more than the second threshold value.

In this way, when the third humidity difference between the plurality of habitable rooms 2 exceeds the third threshold value, the humidifying action of humidifier 16 is executed by the first humidifying control based on the average value of the first humidities before the humidities change to the second humidities. On the other hand, when the third humidity difference between the plurality of habitable rooms 2 is less than or equal to the third threshold value, the humidifying action of humidifier 16 is executed by the second humidifying control based on the average value of the second humidities. Therefore, in air conditioning system 20, even when humidity affected by disturbance (detected humidity) is detected in any of the plurality of habitable rooms 2, unnecessary operation start or operation stop of humidifier 16 is not repeated. As a result, humidification by humidifier 16 can be stably performed.

(4) In air conditioning system 20, controller 50 causes humidifier 16 to switch to and execute the second humidifying control instead of the first humidifying control when the third humidity difference is more than the third threshold value and the detected humidity changes from the second humidity to a fourth humidity differing from the second humidity and in the case of a fourth humidity difference between the second humidity and the fourth humidity being less than or equal to a fourth threshold value.

In this way, even when the third humidity difference between the plurality of habitable rooms 2 exceeds the third threshold value, the humidifying action of humidifier 16 is executed by the second humidifying control when the fourth humidity difference is less than or equal to the fourth threshold value. Therefore, in air conditioning system 20, even when the rapid humidity change is detected in any of the plurality of habitable rooms 2, the humidifying control of the humidity after the change can be executed when such a state continues. As a result, humidification by humidifier 16 can be stably performed.

The present disclosure has been described above according to the first exemplary embodiment. It will be understood by those skilled in the art that the first exemplary embodiment is merely an example, other modifications in which components or processes of the exemplary embodiment are variously combined are possible, and the other modifications are still fall within the scope of the present disclosure.

Second Exemplary Embodiment

In a conventional entire building air conditioning system, a temperature of air in an air conditioning room is controlled by an air conditioning machine (air conditioner) installed in the air conditioning room, and humidity of air in the air conditioning room is humidifying controlled by a humidifier similarly installed in the air conditioning room. Then, air conditioned (temperature-controlled and humidified) by a blower (transfer fan) installed in the air conditioning room is transferred to each habitable room.

However, in a case where the transferring volume of the air transferred to each habitable room (the air volume of the blower) fluctuates, the moisture amount supplied to each habitable room, that is, the humidity of each habitable room fluctuates accordingly. For example, in a case where the transferring volume of the air transferred to each habitable room increases, moisture contained in the air corresponding to the increased transferring volume is excessively supplied to each habitable room, thus the humidity of each habitable room increases.

As described above, in the conventional entire building air conditioning system, the humidity of the air in each habitable room may not be stably maintained at a target humidity. That is, in the conventional entire building air conditioning system, the amount of moisture supplied to each habitable room changes due to the air volume fluctuation of the blower, and there is a problem that the humidifying control by the humidifier is not stable.

The present disclosure provides the air conditioning system capable of performing humidifying control by the humidifier corresponding to air volume fluctuation of the transfer fan.

An air conditioning system according to the present disclosure includes: an air conditioning room configured to introduce air from outside; an air conditioner disposed in the air conditioning room and adjusting temperature of the air in the air conditioning room; a humidifier disposed in the air conditioning room and humidifying the air temperature-adjusted by the air conditioner; a plurality of transfer fans transferring the air in the air conditioning room to a plurality of air-conditioned spaces independent of the air conditioning room, respectively; and a controller controlling the humidifier and the transfer fans. The humidifier is configured to centrifugally crush and micronize the water pumped by the rotation of the water pumping pipe, and release the water contained in the air temperature-controlled by the air conditioner. The controller specifies the rotation speed of the water pumping pipe based on the required humidification amount of the air-conditioned space, the temperature of the air temperature-controlled by the air conditioner, and the air volume of the transfer fan, and controls the humidification amount to the air temperature-controlled by the air conditioner based on the specified rotation speed.

According to the present disclosure, it is possible to provide the air conditioning system capable of performing humidifying control by the humidifier corresponding to air volume fluctuation of the transfer fan.

To explain again, the air conditioning system according to the present disclosure includes: the air conditioning room configured to introduce air from outside; the air conditioner disposed in the air conditioning room and adjusting temperature of the air in the air conditioning room; the humidifier disposed in the air conditioning room and humidifying the air temperature-adjusted by the air conditioner; the plurality of transfer fans transferring air in the air conditioning room to a plurality of air-conditioned spaces independent of the air conditioning room, respectively; and the controller controlling the humidifier and the transfer fans. The humidifier is configured to centrifugally crush and micronize the water pumped by the rotation of the water pumping pipe, and release the water contained in the air temperature-controlled by the air conditioner. The controller specifies the rotation speed of the water pumping pipe based on the required humidification amount of the air-conditioned space, the temperature of the air temperature-controlled by the air conditioner, and the air volume of the transfer fan, and controls the humidification amount to the air temperature-controlled by the air conditioner based on the specified rotation speed.

According to such configuration, even when the transferring volume of the air to be transferred to the air-conditioned space fluctuates, the humidification amount contained in the air to be transferred to the air-conditioned space is adjusted accordingly. Therefore, the variation in the amount of moisture to be supplied to the air-conditioned space is suppressed, and the humidity of the air in the air-conditioned space can be stably maintained at the target humidity. That is, it is possible to provide the air conditioning system capable of performing humidifying control by the humidifier corresponding to the air volume fluctuation of the transfer fan.

In addition, in the air conditioning system according to the present disclosure, the controller may execute control to decrease the rotation speed of the water pumping pipe when the air volume of the transfer fan increases, and execute control to increase the rotation speed of the water pumping pipe when the air volume of the transfer fan decreases. As a result, when the air volume of the transfer fan increases, the humidification amount contained in the air transferred to the air-conditioned space decreases, and when the air volume of the transfer fan decreases, the humidification amount contained in the air transferred to the air-conditioned space increases. Therefore, it is possible to suppress the fluctuation in the amount of moisture supplied to the air-conditioned space due to the fluctuation in the air volume of the transfer fan.

Moreover, in the air conditioning system according to the present disclosure, the water pumping pipe may be rotatable within a range between the lower limit rotation speed and the upper limit rotation speed. The controller may execute control to increase the air volume of the transfer fan when the humidification amount that can be output at the upper limit rotation speed is less than the required humidification amount, and execute control to decrease the air volume of the transfer fan when the humidification amount that can be output at the lower limit rotation speed is more than the required humidification amount.

In this way, when the humidification amount that can be output at the upper limit rotation speed is less than the required humidification amount, the transferring volume of the air transferred to the air-conditioned space increases, thus the amount of moisture to be supplied to the air-conditioned space can be increased. On the other hand, when the humidification amount that can be output at the lower limit rotation speed is more than the required humidification amount, the transferring volume of the air to be transferred to the air-conditioned space decreases, thus the amount of moisture to be supplied to the air-conditioned space can be decreased. That is, in the air conditioning system, the adjustable range of the humidification amount by the humidifier is widened, and highly accurate humidification adjustment can be performed on the air whose temperature has been adjusted by the air conditioner.

Furthermore, the air conditioning system according to the present disclosure may include a damper that adjusts the amount of air flowing into the humidifier. The controller is configured to be able to control the damper, and may execute control to decrease the inlet air volume by the damper when the humidification amount that can be output at the lower limit rotation speed exceeds the required humidification amount. As a result, when the humidification amount that can be output at the lower limit rotation speed exceeds the required humidification amount, the humidification amount contained in the air transferred to the air-conditioned space is further decreased. Therefore, the amount of moisture to be supplied to the air-conditioned space can be further decreased.

Hereinafter, a second exemplary embodiment of the present disclosure will be described with reference to the drawings.

Figure 10:
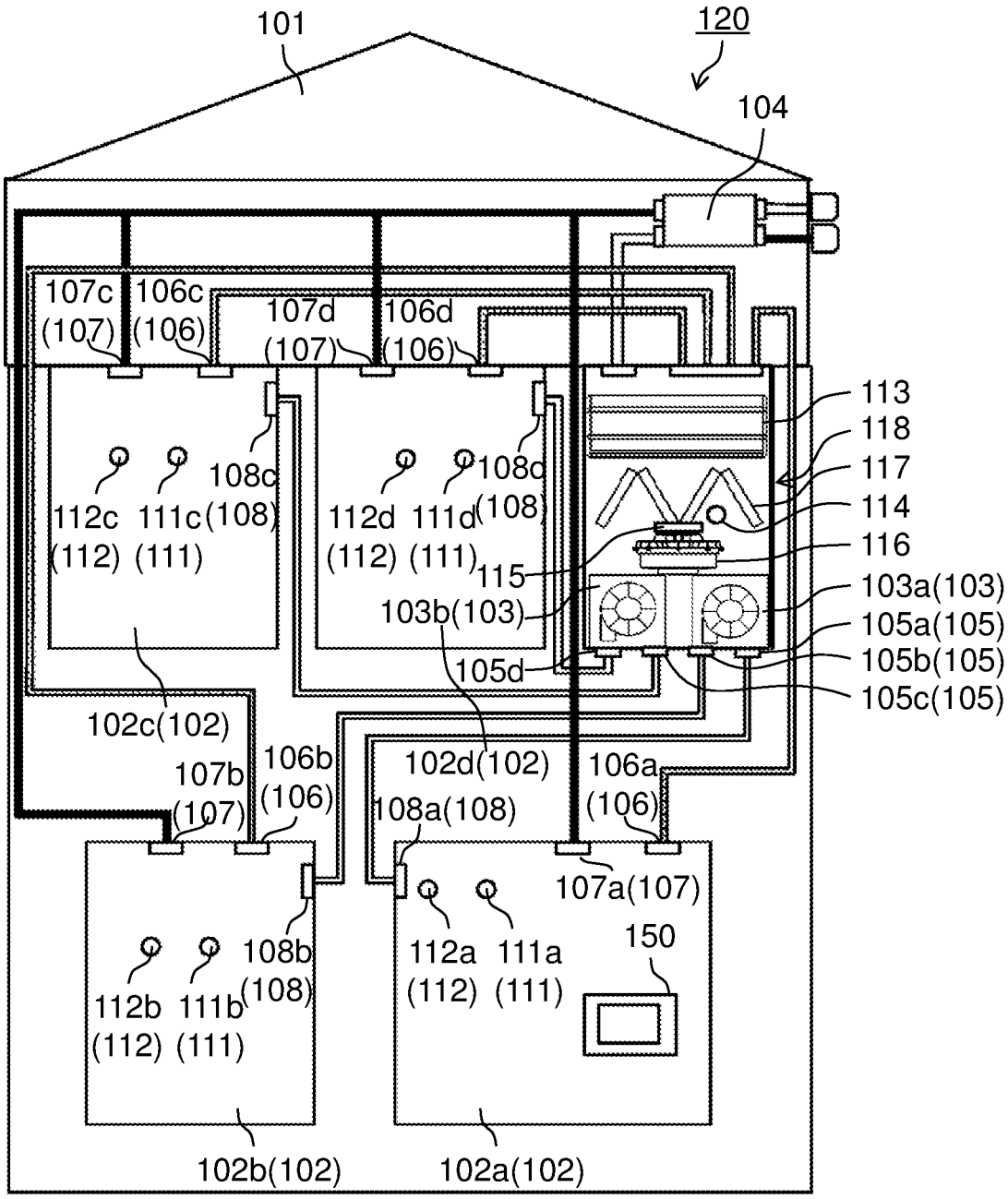
FIG. 10 is a connection schematic diagram of an air conditioning system according to a second exemplary embodiment of the present disclosure.

First, air conditioning system 120 according to the second exemplary embodiment will be described with reference to FIG. 10. FIG. 10 is a connection schematic diagram of air conditioning system 120 according to the second exemplary embodiment.

Air conditioning system 120 is configured by including a plurality of transfer fans 103 (transfer fans 103*a*, 103*b*), heat exchange ventilation fan 104, a plurality of habitable room dampers 105 (habitable room dampers 105*a*, 105*b*, 105*c*, 105*d*), a plurality of circulation ports 106 (circulation ports 106*a*, 106*b*, 106*c*, 106*d*), a plurality of habitable room exhaust ports 107 (habitable room exhaust ports 107*a*, 107*b*, 107*c*, 107*d*), a plurality of habitable room air supply ports 108 (habitable room air supply ports 108*a*, 108*b*, 108*c*, 108*d*), habitable room temperature sensors 111 (habitable room temperature sensors 111*a*, 111*b*, 111*c*, 111*d*), habitable room humidity sensors 112 (habitable room humidity sensors 112*a*, 112*b*, 112*c*, 112*d*), air conditioner (air conditioning machine) 113, inlet temperature sensor 114, inlet damper 115, humidifier 116, dust collection filter 117, and controller 150 (corresponding to an air conditioning controller).

Air conditioning system 120 is installed in general housing 101 that is an example of a building. General housing 101 includes at least one air conditioning room 118 independent of a plurality of (four in the second exemplary embodiment) habitable rooms 102 (habitable rooms 102*a*, 102*b*, 102*c*, 102*d* in addition to habitable rooms 102. Here, general housing 101 (housing) is a residence provided as a place where residents live a private life, and as a general configuration, habitable rooms 102 include a living room, a dining room, a bedroom, a private room, a children's room, and the like. The habitable rooms provided with air conditioning system 120 may include a toilet, a bathroom, a washroom, a dressing room, or the like.

Circulation port 106*a*, habitable room exhaust port 107*a*, habitable room air supply port 108*a*, habitable room temperature sensor 111*a*, habitable room humidity sensor 112*a*, and controller 150 are installed in habitable room 102*a*. Circulation port 106*b*, habitable room exhaust port 107*b*, habitable room air supply port 108*b* habitable room temperature sensor 111*b*, and habitable room humidity sensor 112*b* are installed in habitable room 102*b*. Circulation port 106*c*, habitable room exhaust port 107*c*, habitable room air supply port 108*c* habitable room temperature sensor 111*c*, and habitable room humidity sensor 112*c* are installed in habitable room 102*c*. Circulation port 106*d*, habitable room exhaust port 107*d*, habitable room air supply port 108*d* habitable room temperature sensor 111*d*, and habitable room humidity sensor 112*d* are installed in habitable room 102*d*.

Air conditioning room 118 is provided with transfer fan 103*a*, transfer fan 103*b*, habitable room damper 105*a*, habitable room damper 105*b*, habitable room damper 105*c*, habitable room damper 105*d*, air conditioner 113, inlet temperature sensor 114, inlet damper 115, humidifier 116, and dust collection filter 117. More specifically, air conditioner 113, dust collection filter 117, inlet temperature sensor 114, inlet damper 115, humidifier 116, transfer fans 103 (transfer fans 103*a*, 103*b*), and habitable room dampers 105 (habitable room dampers 105*a*, 105*b*, 105*c*, 105*d*) are disposed in this order from the upstream side of the flow path of the air flowing in air conditioning room 118.

Air is introduced into air conditioning room 118 from the outside of air conditioning room 118. Then, the air (indoor air) transferred from each habitable room 102 through circulation port 106 and the outside air (outdoor air) taken in and heat exchanged by heat exchange ventilation fan 104 are mixed in air conditioning room 118. Temperature and humidity of the air in air conditioning room 118 are respectively controlled, that is, respectively conditioned by air conditioner 113 and humidifier 116 provided in air conditioning room 118, so that the air to be transferred to habitable rooms 102 is generated. The air conditioned in air conditioning room 118 is transferred to respective habitable rooms 102 by transfer fans 103. Here, air conditioning room 118 means a space having a certain size in which air conditioner 113, inlet temperature sensor 114, inlet damper 115, humidifier 116, dust collection filter 117, and the like can be disposed, and the air conditioning of each habitable room 102 can be controlled, but is not intended as a living space, and basically does not mean a room in which a resident stays.

A part of the air in habitable rooms 102 is transferred to air conditioning room 118 through circulation ports 106, and other part of the air is transferred through habitable room exhaust ports 107, heat exchanged by heat exchange ventilation fan 104, and discharged outside. Air conditioning system 120 takes outside air (outdoor air) in while discharging inside air (indoor air) from habitable rooms 102 through heat exchange ventilation fan 104 to perform ventilation with a first-type ventilation method. A ventilation air volume of heat exchange ventilation fan 104 can be set in a plurality of stages, and the ventilation air volume is set so as to satisfy a required ventilation volume defined by laws and regulations.

Heat exchange ventilation fan 104 is configured by including an air supply fan (not illustrated) and an air exhaust fan (not illustrated) therein, and ventilates while exchanging heat between inside air (indoor air) and outside air (outdoor air) by operating the fans. At this time, heat exchange ventilation fan 104 transfers the heat-exchanged outside air to air conditioning room 118.

Transfer fans 103 are provided on a wall surface (a wall surface on the bottom surface side) of air conditioning room 118. The air in air conditioning room 118 is transferred from habitable room air supply ports 108 to habitable rooms 102 through the transfer ducts by transfer fans 103. More specifically, the air in air conditioning room 118 is transferred to each of habitable rooms 102*a* and 102*b* located on a first floor of general housing 101 by transfer fan 103*a*, and is transferred to each of habitable rooms 102*c* and 102*d* located on a second floor of general housing 101 by transfer fan 103*b*. The transfer ducts connected to habitable room air supply ports 108 of habitable rooms 102 are provided independently of each other.

Habitable room dampers 105 adjust the air blowing volume of air to habitable rooms 102 respectively by adjusting opening degrees of habitable room dampers 105 when transferring air from transfer fans 103 to habitable rooms 102. More specifically, habitable room damper 105*a* adjusts the air blowing volume to habitable room 102*a* located on the first floor. Habitable room damper 105*b* adjusts the air blowing volume to habitable room 102*b* located on the first floor. Habitable room damper 105*c* adjusts the air blowing volume to habitable room 102*c* located on the second floor. Habitable room damper 105*d* adjusts the air blowing volume to habitable room 102*d* located on the second floor.

A part of the air in habitable rooms 102 (habitable rooms 102*a* to 102*d*) is transferred to air conditioning room 118 through the circulation ducts from corresponding circulation ports 106 (circulation ports 106*a* to 106*d*), respectively. Here, the air transferred through circulation port 106 is naturally transferred to air conditioning room 118 as circulating air by a difference between the volume of air (volume of supply air) transferred from air conditioning room 118 to respective habitable rooms 102 by transfer fans 103 and the volume of air (volume of exhaust air) exhausted outside from habitable room exhaust ports 107 by heat exchange ventilation fan 104. Although the circulation ducts that connect air conditioning room 118 and habitable rooms 102 may be provided independently of each other, a plurality of branch ducts that is a part of the circulation ducts may be joined at the middle to be integrated as one circulation duct, and the one circulation duct may be connected to air conditioning room 118.

As described above, circulation ports 106 (circulation ports 106*a* to 106*d*) are openings for respectively transferring the indoor air from habitable rooms 102 (habitable rooms 102*a* to 102*d*) to air conditioning room 118.

As described above, habitable room exhaust ports 107 (habitable room exhaust ports 107*a* to 107*d*) are openings for respectively transferring indoor air from habitable rooms 102 (habitable rooms 102*a* to 102*d*) to heat exchange ventilation fan 104.

As described above, habitable room air supply ports 108 (habitable room air supply ports 108*a* to 108*d*) are openings for respectively transferring air in air conditioning room 118 from air conditioning room 118 to habitable rooms 102 (habitable rooms 102*a* to 102*d*).

Habitable room temperature sensors 111 (habitable room temperature sensors 111*a* to 111*d*) are sensors that respectively acquire the habitable room temperatures (habitable room temperatures) of corresponding habitable rooms 102 (habitable rooms 102*a* to 102*d*), and transmit the temperatures to controller 150.

Habitable room humidity sensors 112 (habitable room humidity sensors 112*a* to 112*d*) are sensors that respectively acquire the habitable room humidities (room humidities) of corresponding habitable rooms 102 (habitable rooms 102*a* to 102*d*), and transmit the humidities to controller 150.

Air conditioner 113 corresponds to an air conditioning machine, and controls air conditioning of air conditioning room 118. Air conditioner 113 cools or heats the air in air conditioning room 118 so that the temperature of the air in air conditioning room 118 becomes a set temperature (air conditioning room target temperature). Here, a required air conditioning amount is calculated from a temperature difference between a target temperature (habitable room target temperature) set by a user and the habitable room temperature, and a temperature based on the calculated result is set to the set temperature. In the second exemplary embodiment, a temperature at least higher than the target temperature is set to the set temperature in order to adjust the temperature of the air in each habitable room 102 to the target temperature more quickly.

Inlet temperature sensor 114 is a sensor that acquires a temperature of air temperature-controlled by air conditioner 113 in air conditioning room 118 and transmits the temperature to controller 150. More specifically, inlet temperature sensor 114 is installed on the downstream side of dust collection filter 117 in air conditioning room 118, acquires the temperature of the air to be sucked into humidifier 116, and transmits the temperature to controller 150.

Figure 11:
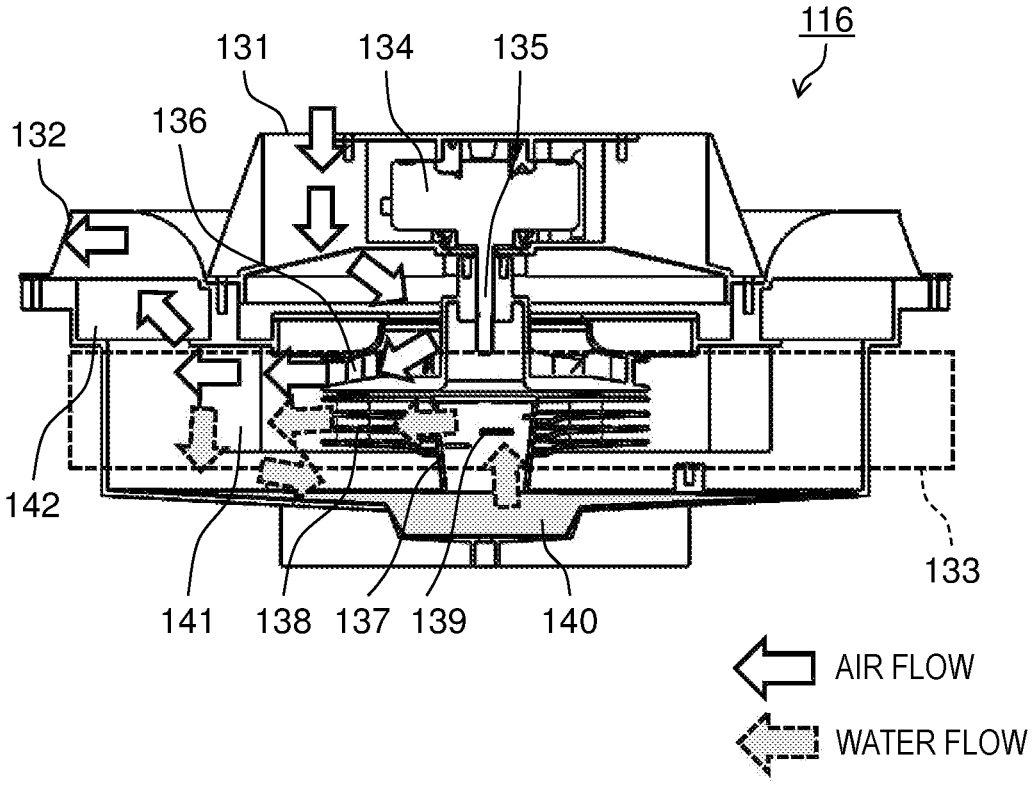
FIG. 11 is a schematic cross-sectional view of a humidifier configuring the air conditioning system.

Inlet damper 115 is installed corresponding to inlet 131 of humidifier 116 described later with reference to FIG. 11, and adjusts an inflow volume of air into the inside of humidifier 116 by adjusting the opening degree of inlet damper 115 when air in air conditioning room 118 is sucked from inlet 131.

Humidifier 116 is located downstream of air conditioner 113 (and dust collection filter 117) in air conditioning room 118, and humidifies the air in air conditioning room 118 so that the humidity (habitable room humidity) of the air in each of habitable rooms 102 becomes the target humidity when the humidity is lower than the target humidity (habitable room target humidity) set by the user. In addition, the humidity in the second exemplary embodiment is indicated by relative humidity, but may be treated as absolute humidity by predetermined conversion processing. In this case, entire handling of the humidities of air conditioning system 120 including the humidity of habitable rooms 102 is preferably handled as the absolute humidities. Details of humidifier 116 will be described later.

Dust collection filter 117 is a dust collection filter that collects particles floating in the air introduced into air conditioning room 118. Dust collection filter 117 collects particles contained in the air transferred into air conditioning room 118 through circulation ports 106, thereby making the air to be supplied indoors by transfer fans 103 clean. Here, dust collection filter 117 is installed so as to obstruct the air flow path in the region between air conditioner 113 and humidifier 116.

Controller 150 is a controller that controls air conditioning system 120 in whole. Controller 150 is connected to be communicable with each of heat exchange ventilation fan 104, transfer fans 103, habitable room dampers 105, habitable room temperature sensors 111, habitable room humidity sensors 112, air conditioner 113, inlet temperature sensor 114, inlet damper 115, and humidifier 116 by wireless communication.

Controller 150 also controls air conditioner 113 as an air conditioning machine, humidifier 116, the opening degree of inlet damper 115, the air volumes of transfer fans 103, and the opening degrees of habitable room dampers 105 in accordance with the habitable room temperature and the habitable room humidity of each habitable room 102 respectively acquired by habitable room temperature sensor 111 and habitable room humidity sensor 112, the set temperature (habitable room set temperature) and the set humidity (habitable room set humidity) set for each of habitable rooms 102*a* to 102*d*, and the temperature and the like of the air in air conditioning room 118 acquired by inlet temperature sensor 114. The air volumes of transfer fans 103 may be individually controlled.

As a result, the air conditioned in air conditioning room 118 is transferred to respective habitable rooms 102 with respective air volumes being set by respective transfer fans 103 and respective habitable room dampers 105. Therefore, the habitable room temperature and the habitable room humidity of each habitable room 102 are respectively controlled to be the habitable room set temperature and the habitable room set humidity.

Here, since controller 150 is connected with heat exchange ventilation fan 104, transfer fans 103, habitable room dampers 105, habitable room temperature sensors 111, habitable room humidity sensors 112, air conditioner 113, inlet temperature sensor 114, inlet damper 115, and humidifier 116 by wireless communication, a complicated wiring construction is eliminated. However, all these devices, or controller 150 and a part of these devices may be configured to be able to communicate by wired communication.

Next, a configuration of humidifier 116 will be described with reference to FIG. 11. FIG. 11 is a schematic cross-sectional view of humidifier 116 configuring air conditioning system 120.

Humidifier 116 is located downstream of air conditioner 113 in air conditioning room 118, and is a device for humidifying the air in air conditioning room 118 by centrifugal water crushing. In other words, humidifier 116 is a device configured to centrifugally crush and micronize the water pumped by the rotation of water pumping pipe 137, and cause the water to be contained in the air temperature-controlled by air conditioner 113 and to be released.

Humidifier 116 includes inlet 131 for sucking the air in air conditioning room 118, outlet 132 for blowing out humidified air into air conditioning room 118, an air passage provided between inlet 131 and outlet 132, and liquid atomization chamber 133 provided in the air passage.

Inlet 131 is provided on an upper surface of a housing constituting an outer frame of humidifier 116. Outlet 132 is provided on a side surface of the housing. Liquid atomization chamber 133 is a main part of humidifier 116, and performs micronization of water by a centrifugal water crushing method. As illustrated in FIG. 10, inlet damper 115 is attached to inlet 131.

Specifically, humidifier 116 includes rotary motor 134, rotary shaft 135 rotated by rotary motor 134, centrifugal fan 136, cylindrical water pumping pipe 137, water storage 140, first eliminator 141, and second eliminator 142.

Water pumping pipe 137 is fixed to rotary shaft 135 inside liquid atomization chamber 133, and pumps up water from a circular pumping port provided vertically downward thereof while rotating in accordance with the rotation of rotary shaft 135. More specifically, water pumping pipe 137 has an inverted conical hollow structure, and includes the circular pumping port vertically downward thereof, and rotary shaft 135 disposed in the vertical direction is fixed to the center of the top surface of the inverted conical shape above water pumping pipe 137. Since rotary shaft 135 is connected to rotary motor 134 positioned vertically above liquid atomization chamber 133, the rotary motion of rotary motor 134 is conducted to water pumping pipe 137 through rotary shaft 135, and water pumping pipe 137 rotates.

Water pumping pipe 137 includes a plurality of rotary plates 138 formed on the top surface side of the inverted conical shape so as to protrude outward from the outer surface of water pumping pipe 137. The plurality of rotary plates 138 are disposed so as to protrude outward from the outer surface of water pumping pipe 137 with predetermined intervals being provided respectively in the axial direction of rotary shaft 135 between rotary plates 138 vertically adjacent to each other. Since rotary plates 138 rotate together with water pumping pipe 137, rotary plates 138 preferably have a horizontal disc shape coaxial with rotary shaft 135. Note that the number of rotary plates 138 is appropriately set in accordance with target performance or a dimension of water pumping pipe 137.

A wall surface of water pumping pipe 137 is provided with a plurality of openings 139 penetrating the wall surface of water pumping pipe 137. Each of the plurality of openings 139 is provided at a position where the inside of water pumping pipe 137 communicates with the upper surfaces of rotary plates 138 formed so as to protrude outward from the outer surface of water pumping pipe 137.

Centrifugal fan 136 is disposed vertically above water pumping pipe 137, and is a fan for taking air into the device from air conditioning room 118. Centrifugal fan 136 is fixed to rotary shaft 135 like water pumping pipe 137, and rotates in accordance with the rotation of rotary shaft 135 to introduce air into liquid atomization chamber 133. Note that the flow volume of the air introduced into humidifier 116 (air introduced into liquid atomization chamber 133) increases or decreases under the influence of the air volume of transfer fans 103.

Water storage 140 stores water to be pumped by water pumping pipe 137 through the pumping port vertically below water pumping pipe 137. Water storage 140 is designed to have a depth in which a part of the lower portion of water pumping pipe 137, for example, a length of about ⅓ to 1/100 of the conical height of water pumping pipe 137 is immersed. This depth can be designed in accordance with a required pumping amount. The bottom surface of water storage 140 is formed as a mortar shape towards the pumping port. Water is supplied to water storage 140 by a water supply portion (not illustrated).

First eliminator 141, which is a porous body through which air can flow, is provided on the side (outer peripheral portion in the centrifugal direction) of liquid atomization chamber 133, and is disposed so that air flows in the centrifugal direction. Water droplets discharged from opening 139 of water pumping pipe 137 collide with first eliminator 141 to be micronized, and first eliminator 141 collects the water droplets out of water contained in the air passing through liquid atomization chamber 133. As a result, the air flowing in humidifier 116 contains vaporized water.

Second eliminator 142 is provided downstream of first eliminator 141, and is disposed so that air flows vertically upward. Second eliminator 142 is also the porous body through which air can flow, and when air passing through second eliminator 142 collides with second eliminator 142, the water droplets of water contained in the air passing through second eliminator 142 are collected. As a result, the micronized water droplets are doubly collected by the two eliminators, thereby colleting water droplets having a large particle size more accurately.

Next, an operation principle of humidification (micronization of water) in humidifier 116 will be described with reference to FIG. 11. In FIG. 11, the air flow and the water flow in humidifier 116 are indicated by arrows.

First, when the operation of humidifier 116 is started, rotary shaft 135 is caused to be rotated at a first rotation speed by rotary motor 134, and the air in air conditioning room 118 is started to be sucked from inlet 131 by centrifugal fan 136. Then, water pumping pipe 137 rotates at the first rotation speed in accordance with the rotation of rotary shaft 135. Then, in the water flow indicated by dashed arrows in FIG. 11, the water stored in water storage 140 is pumped up by a centrifugal force that is generated by the rotation of water pumping pipe 137. Here, the first rotation speed of rotary motor 134 (water pumping pipe 137) is set, for example, between 500 rpm and 3000 rpm in accordance with an air blowing volume and a humidification amount for air. Since water pumping pipe 137 has the inverted conical hollow structure, water pumped up by rotation is pumped up along the inner wall of water pumping pipe 137. Then, the pumped water is discharged in the centrifugal direction from opening 139 of water pumping pipe 137 along rotary plates 138 and scattered as water droplets.

The water droplets scattered from rotary plates 138 fly in a space (liquid atomization chamber 133) surrounded by first eliminator 141, and collide with first eliminator 141 to be micronized. On the other hand, the air passing through liquid atomization chamber 133 moves to the outer peripheral portion of first eliminator 141 while containing the water crushed (micronized) by first eliminator 141 as in an air flow indicated by solid arrows in FIG. 11. During air flowing in the air passage from first eliminator 141 to second eliminator 142, vortexes of air flow is generated, and water and air are mixed. The air containing water then passes through second eliminator 142. As a result, humidifier 116 can humidify the air sucked from inlet 131 and blow out the humidified air from outlet 132.

Note that the liquid to be micronized may be other than water, and may be, for example, a liquid such as hypochlorous acid water having bactericidal properties or deodorization properties.

Figure 12:
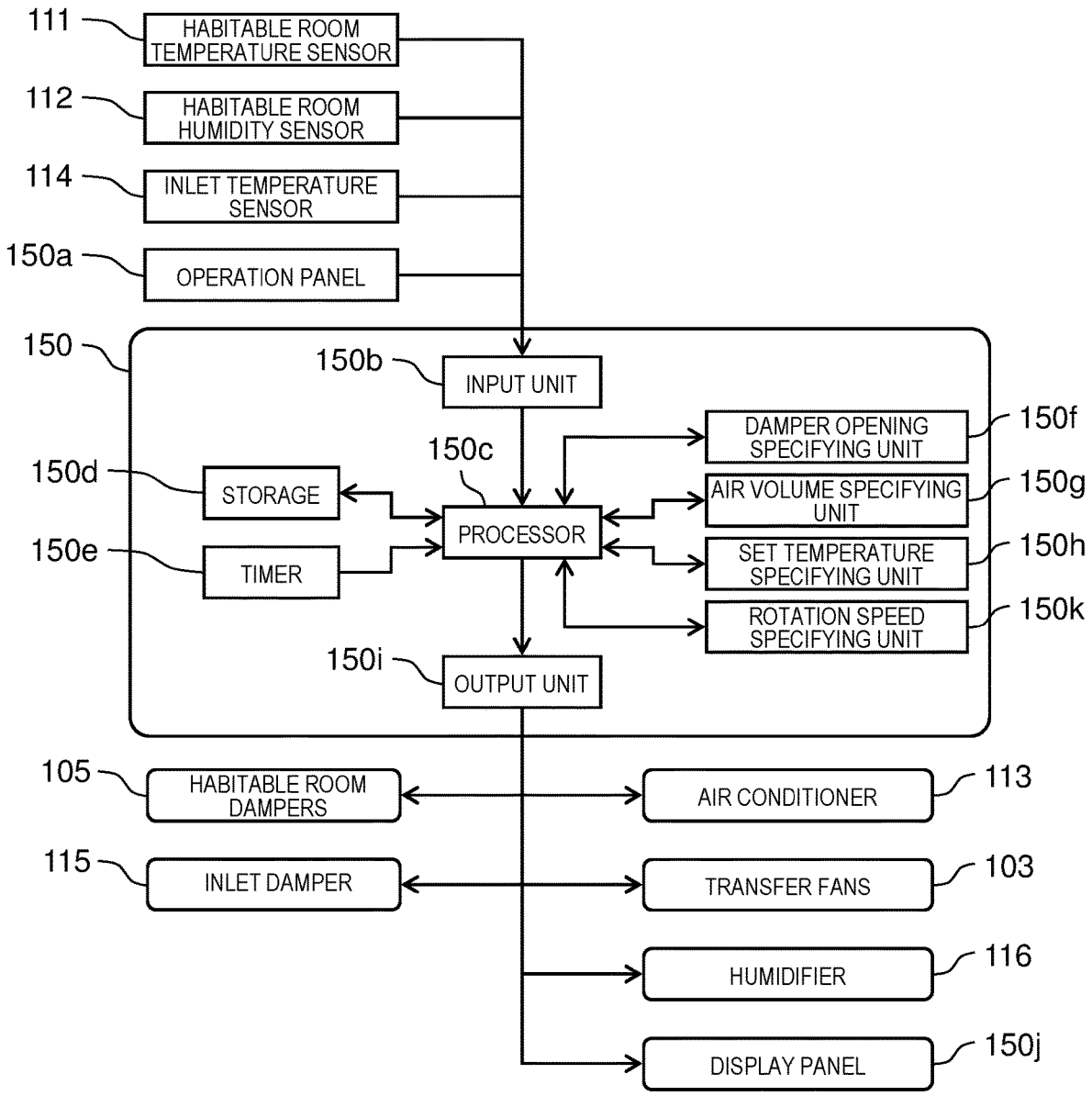
FIG. 12 is a schematic functional block diagram of a controller of the air conditioning system.

Next, controller 150 in air conditioning system 120 will be described with reference to FIG. 12. FIG. 12 is a schematic functional block diagram of controller 150 in air conditioning system 120.

Controller 150 is installed on a wall surface in a habitable room that is a main living space of general housing 101, such as a living room, and controls operations of air conditioner 113, transfer fans 103, habitable room dampers 105, inlet damper 115, and humidifier 116. In addition, controller 150 is installed at a height of about a height of human face from the floor of the habitable room in order to facilitate the operation by users. Controller 150 has a rectangular shape, and includes display panel **150*j* in a front central region of the main body and operation panel 150*a* in a right region of display panel 150*j***.

Display panel **150*j* is a liquid crystal monitor or the like, and displays operation statuses of air conditioner 113, transfer fans 103, habitable room dampers 105, inlet damper 115, and humidifier 116, and the habitable room set temperatures, the habitable room set humidities, the current habitable room temperatures and the habitable room humidities of habitable rooms 102**, and the like on a display screen.

Operation panel 150*a* is a button switch or the like for the user to input the habitable room set temperatures, the habitable room set humidities, and the like for habitable rooms 102.

In controller 150, a control unit including a CPU, a memory, and the like of the computer is housed inside the main body.

Specifically, the control unit of controller 150 includes input unit 150*b*, processor 150*c*, storage 150*d*, timer 150*e*, damper opening specifying unit 150*f*, air volume specifying unit 150*g*, set temperature specifying unit 150*h*, rotation speed specifying unit 150*k*, and output unit 150*i*.

Input unit 150*b* receives information (first information) on the habitable room temperatures of habitable rooms 102 from habitable room temperature sensors 111, the information (second information) on the habitable room humidities of habitable rooms 102 from habitable room humidity sensors 112, the information (third information) on the inlet temperature of humidifier 116 from inlet temperature sensor 114, and the information (fourth information) on the input setting of the user from the operation panel 150*a*. Input unit 150*b* outputs received the first information to the fourth information to processor 150*c*.

Storage 150*d* stores data to be referred to or updated by processor 150*c*. For example, storage 150*d* stores an algorithm for determining operation modes of air conditioner 113, humidifier 116, and transfer fans 103. In addition, storage 150*d* stores the first information to the fourth information received by input unit 150*b* in time series. Then, storage 150*d* outputs the stored data (memory data) to processor 150*c* in response to a request from processor 150*c*.

Timer 150*e* is used for measuring time as necessary in the program executed by processor 150*c*. Then, timer 150*e* outputs data (time data) indicating the current time to processor 150*c*.

Processor 150*c* receives the first information to the fourth information from input unit 150*b*, the stored data from storage 150*d*, and the time data from timer 150*e*. Processor 150*c* specifies the required air conditioning amount and the required humidification amount required for habitable rooms 102 at regular time intervals (for example, 5 minutes) using each piece of received information. More specifically, processor 150*c* specifies the required air conditioning amount individually required for each of habitable rooms 102*a* to 102*d* based on the temperature differences between the habitable room set temperatures stored in storage 150*d* and the room temperatures detected by habitable room temperature sensors 111*a* to 111*d* respectively installed in habitable rooms 102*a* to 102*d* at regular time intervals based on the time data acquired from timer 150*e*. Similarly, processor 150*c* specifies the required humidification amount individually required for each of habitable rooms 102*a* to 102*d* based on the humidity differences between the habitable room set humidities stored in storage 150*d* and the habitable room humidities detected by habitable room humidity sensors 112*a* to 112*d* respectively installed in habitable rooms 102*a* to 102*d* at regular time intervals based on the time data acquired from timer 150*e*. In addition, processor 150*c* updates the display of display panel 150*j* via output unit 150*i* according to the change in the information to be displayed on display panel 150*j*.

Damper opening specifying unit 150*f* acquires the information related to the required air conditioning amounts from processor 150*c*, and specifies the opening degrees of habitable room dampers 105*a* to 105*d* based on a ratio of the required air conditioning amount for each of habitable rooms 102*a* to 102*d*. Although described in detail later, damper opening specifying unit 150*f* specifies the opening of inlet damper 115 according to the air blowing control operation of transfer fans 103. Then, damper opening specifying unit 150*f* outputs the information (opening degree information) related to the specified opening degrees of habitable room dampers 105*a* to 105*d* and inlet damper 115 to processor 150*c*.

Air volume specifying unit 150*g* acquires the information related to the required air conditioning amounts from processor 150*c*, and specifies the blown air volume of air conditioner 113 based on the average value or the total value of the required air conditioning amounts. In addition, air volume specifying unit 150*g* specifies the air blowing volumes of transfer fans 103 (transfer fan 103*a* and transfer fan 103*b*) based on the average value or the total value of the required air conditioning volumes of the first floor and the second floor, respectively. Then, air volume specifying unit 150*g* outputs the information (blown air volume information) related to the specified blown air volume of air conditioner 113 and the information (air blowing volume information) related to the specified air blowing volumes of transfer fans 103 to processor 150*c*.

Set temperature specifying unit 150*h* acquires the information related to the required air conditioning amounts from processor 150*c*, and specifies the set temperature of air conditioner 113 based on the average value or the total value of the required air conditioning amounts. Set temperature specifying unit 150*h* outputs the information (air conditioner set temperature information) related to the specified set temperature of air conditioner 113 to processor 150*c*.

Rotation speed specifying unit 150*k* acquires the information related to the required air conditioning amounts, the information related to the inlet temperature of humidifier 116, and the air blowing volume information from processor 150*c*, and specifies the rotation speed of water pumping pipe 137 (rotary motor 134) of humidifier 116. Then, rotation speed specifying unit 150*k* outputs the information (rotation speed information) related to the specified rotation speed of water pumping pipe 137 to processor 150*c*.

Processor 150*c* receives the opening degree information from damper opening specifying unit 150*f*, the blown air volume information and the air blowing volume information from air volume specifying unit 150*g*, the air conditioner set temperature information from set temperature specifying unit 150*h*, and the rotation speed information from rotation speed specifying unit 150*k*. Using the received information, processor 150*c* respectively specifies control information related to operations of each of air conditioner 113, transfer fans 103 (transfer fan 103*a*, transfer fan 103*b*), habitable room dampers 105 (habitable room dampers 105*a* to 105*d*), inlet damper 115, and humidifier 116. Then, processor 150*c* outputs the specified control information to output unit 150*i*.

Output unit 150*i* outputs the control information received from processor 150*c* to air conditioner 113, transfer fans 103 (transfer fan 103*a*, transfer fan 103*b*), habitable room dampers 105 (habitable room dampers 105*a* to 105*d*), inlet damper 115, and humidifier 116, respectively.

Air conditioner 113 executes the air conditioning operation at the air conditioning set temperature and the blown air volume based on the control information in accordance with the control information output from output unit 150*i*. In addition, transfer fans 103 (transfer fan 103*a*, transfer fan 103*b*) execute the air blowing operations at respective air blowing volumes based on the control information according to the control information output from output unit 150*i*. Moreover, habitable room dampers 105 (habitable room dampers 105*a* to 105*d*) execute the air volume adjustment operations at respective opening degrees based on the control information according to the control information output from output unit 150*i*. Moreover, inlet damper 115 executes the air volume adjusting operation at the opening degree based on the control information in accordance with the control information output from output unit 150*i*. Furthermore, humidifier 116 performs the rotation operation of water pumping pipe 137 at the rotation speed based on the control information in accordance with the control information output from output unit 150*i*.

As described above, controller 150 causes air conditioner 113, transfer fans 103, habitable room dampers 105, inlet damper 115, and humidifier 116 to execute their respective operations.

Figure 13:
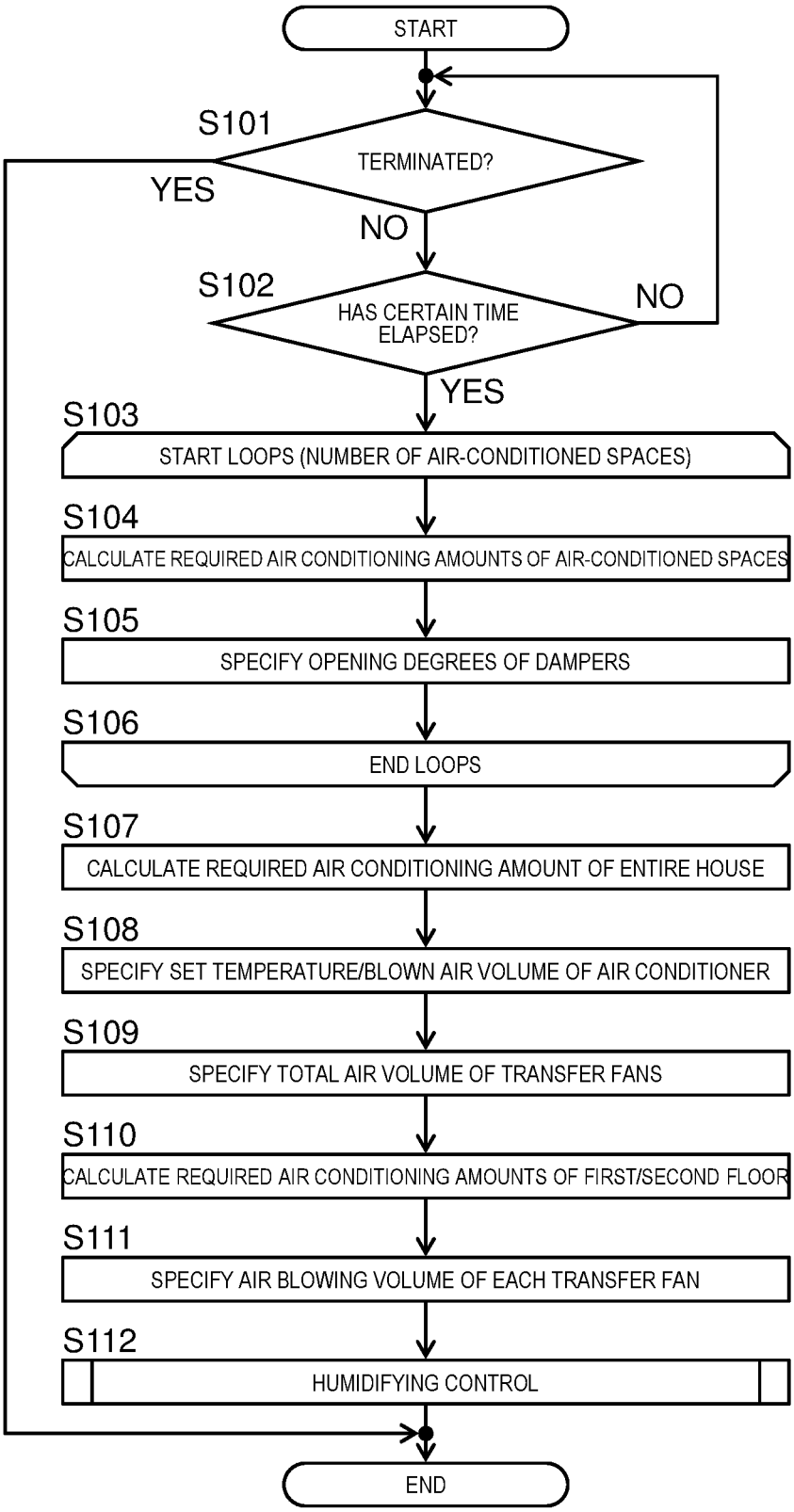
FIG. 13 is a flowchart illustrating a basic processing operation of the controller.

Next, a basic operation of controller 150 will be described with reference to FIG. 13. FIG. 13 is a flowchart illustrating a basic processing operation of controller 150.

First, controller 150 determines termination of air conditioning system 120 (step S101). When the power supply of air conditioning system 120 is turned off (or the operation stop instruction of air conditioning system 120 is input from operation panel 150*a*) (YES in step S101), controller 150 ends the operation of air conditioning system 120. On the other hand, when air conditioning system 120 is powered on (NO in step S101), controller 150 determines whether time has elapsed (step S102). When a certain period of time (for example, 10 minutes) has not elapsed from the previous processing (NO in step S102), controller 150 returns to step S101. On the other hand, when the certain period of time has elapsed since the previous process (YES in step S102), the process proceeds to step S103, and controller 150 performs an output specifying process for habitable room dampers 105, air conditioner 113, and transfer fans 103.

First, controller 150 starts loops for the number of habitable rooms 102 (step S103). Then, controller 150 calculates required air conditioning amount for each of habitable rooms 102*a* to 102*d* (step S104). In addition, controller 150 specifies the opening degrees of habitable room dampers 105*a* to 105*d* corresponding to habitable rooms 102*a* to 102*d*, respectively (step S105). When the calculation of the required air conditioning amounts of all habitable rooms 102 and the specification of the opening degrees of all habitable room dampers 105 are completed, controller 150 ends the loops (step S106).

The processing in the loop of step S103 to step S106 will be described in more detail using habitable room 102*a* as an example.

In step S104, controller 150 specifies the required air conditioning amount of habitable room 102*a* as a temperature difference between the habitable room temperature acquired from habitable room temperature sensor 111*a* and the habitable room set temperature set for habitable room 102*a*. More specifically, the required air conditioning amount is specified based on a value obtained by subtracting the habitable room temperature from the habitable room set temperature during the heating operation, and is specified based on a value obtained by subtracting the habitable room set temperature from the habitable room temperature during the cooling operation. This means that the larger the required air conditioning amount is at a positive value, the more air conditioning is required for habitable room 102*a*.

In step S105, the opening degree of habitable room damper 105*a* corresponding to habitable room 102*a* is specified in accordance with the required air conditioning amount of habitable room 102*a*. In the second exemplary embodiment, the opening degree is "100%" when the required air conditioning amount is 2° C. or more, the opening degree is "60%" when the required air conditioning amount is 1° C. or more and less than 2° C., the opening degree is "45%" when the required air conditioning amount is 0° C. or more and less than 1° C., the opening degree is "30%" when the required air conditioning amount is-1° C. or more and less than 0° C., and the opening degree is "10%" when the required air conditioning amount is less than −1° C. By setting in this manner, the opening degrees of habitable room dampers 105*a* to 105*d* are set in accordance with the ratio of the required air conditioning amounts of habitable rooms 102*a* to 102*d*, and the more air-conditioned air is blown to the habitable room (habitable room 102) having the higher required air conditioning amount, thus the temperature of each habitable room 102 can be controlled.

Next, controller 150 calculates the required air conditioning amount of entire general housing 101 based on respective required air conditioning amounts of habitable rooms 102 (step S107). In the second exemplary embodiment, the required air conditioning amount of general housing 101 is calculated based on the average value of the required air conditioning amounts of habitable rooms 102.

Subsequently, controller 150 specifies an air conditioning set temperature and a blown air volume of air conditioner 113 in accordance with the calculated required air conditioning amount of general housing 101 (step S108). More specifically, controller 150 sets the air conditioning set temperature higher as the required air conditioning amount is higher during the heating operation, and sets the air conditioning set temperature lower as the required air conditioning amount is higher during the cooling operation. For example, controller 150 sets the air conditioning set temperature to the same value as the habitable room set temperature of habitable room 102 when the required air conditioning amount is less than 0° C., and sets the air conditioning set temperature to be 1° C. higher than the habitable room set temperature of habitable room 102 during the heating operation and 1° C. lower than the habitable room set temperature of habitable room 102 during the cooling operation when the required air conditioning amount is 0° C. or more and less than 1° C. When the required air conditioning amount is 1° C. or more, controller 150 sets the air conditioning set temperature to be higher than the habitable room set temperature of habitable room 102 by 2° C. during the heating operation and lower by 2° C. during the cooling operation. As a result, the higher the required air conditioning amount, the higher the output of air conditioner 113 is operated, and the habitable room temperature of habitable room 102 is controlled to the habitable room set temperature earlier.

Controller 150 controls the blown air volume of air conditioner 113 such that the larger the required air conditioning amount, the larger the blown air volume. In the second exemplary embodiment, the blown air volume is set to 500 $m^3$/h when the required air conditioning amount is less than 0° C., the blown air volume is set to 700 $m^3$/h when the required air conditioning amount is 0° C. or more and less than 1° C., and the blown air volume is set to 1200 $m^3$/h when the required air conditioning amount is 2° C. or more.

Subsequently, controller 150 specifies the total air volume of transfer fans 103 so as to be equal to or slightly larger than the blown air volume of air conditioner 113 (step S109). In other words, controller 150 specifies the air volume difference between the total air volume of transfer fans 103 and the blown air volume of air conditioner 113 to be less than or equal to the reference air volume. As a result, controller 150 suppresses the power consumption of transfer fans 103.

Next, controller 150 calculates respective required air conditioning amounts of the first floor and the second floor (step S110). In the second exemplary embodiment, the average values of the required air conditioning amounts of habitable rooms 102 on each of the first floor and the second floor are set as the required air conditioning amounts of the respective floors.

Subsequently, the air blowing volumes of transfer fans 103 are specified based on the required air conditioning amounts calculated in step S110 (step S111). Controller 150 specifies the air blowing volume of each of transfer fans 103 for the first floor and the second floor so as to set the air volume ratio in accordance with the ratio of the required air conditioning amounts. Specifically, when the required air conditioning amount of the second floor is 1° C., the required air conditioning amount of the first floor is 2° C., and the total air volume of transfer fans 103 specified in step S109 is 1200 $m^3$/h, controller 150 specifies the air blowing volume of the transfer fan 103*a* for the second floor as 400 $m^3$/h and the air volume of the transfer fan 103*b* for the first floor as 800 $m^3$/h so that the air volume ratio between the transfer fans 103 becomes 1:2. As a result, even when there is the difference in the required air conditioning amounts between the first floor and the second floor, the difference in the air blowing volumes by transfer fans 103 causes the difference in the amount of heat to be transferred, thus both the first floor and the second floor can be transferred the amount of heat corresponding to the required air conditioning amounts.

Subsequently, controller 150 starts the humidifying control (step S112).

Figure 14:
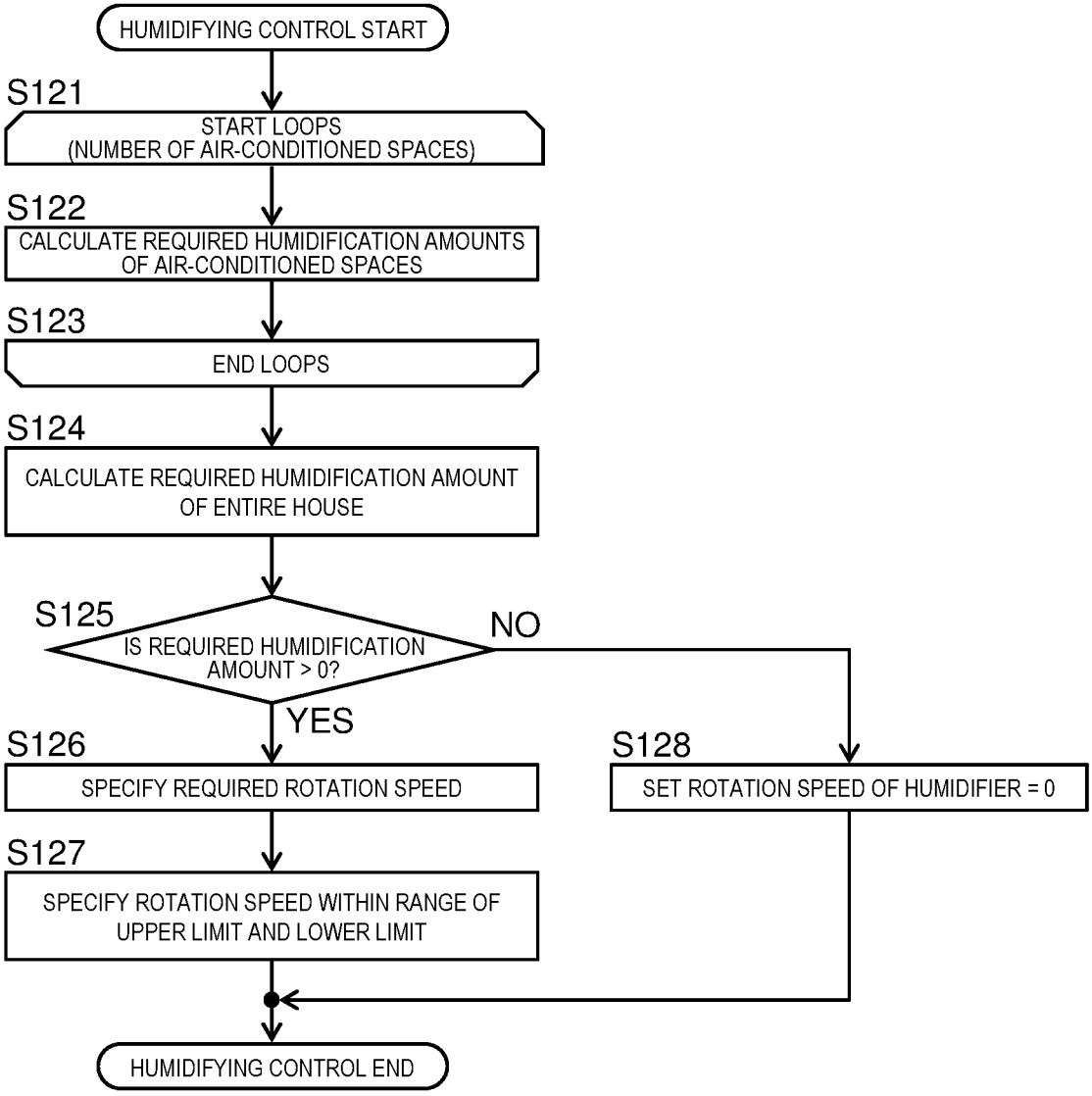
FIG. 14 is a flowchart illustrating a humidifying control operation of the controller.

Next, the humidifying control will be described with reference to FIGS. 14 and 15. FIG. 14 is a flowchart illustrating a humidifying control operation of controller 150. FIG. 15 is a diagram illustrating humidification performance data of humidifier 116.

When the humidifying control is started, controller 150 starts loops for the number of habitable rooms 102 which are the air-conditioned spaces (step S121). Then, controller 150 calculates a required humidification amount for each of habitable rooms 102*a* to 102*d* (step S122). When the calculation of the required humidification amounts of all habitable rooms 102 is completed, controller 150 ends the loops (step S123).

The processing in the loop of step S121 to step S123 will be described in more detail using habitable room 102*a* as an example.

In step S122, controller 150 specifies the required humidification amount for habitable room 102*a* as a humidity difference between the habitable room humidity acquired from habitable room humidity sensor 112*a* and the habitable room set humidity set for habitable room 102*a*. Specifically, controller 150 converts each of the habitable room set humidity and the habitable room humidity into the absolute humidity, and sets a value obtained by subtracting the habitable room absolute humidity from the habitable room set absolute humidity as the required humidification amount. This means that the larger the required humidification amount is at a positive value, the more humidification is required for habitable room 102*a*.

Next, controller 150 calculates the required humidification amount of entire general housing 101 based on respective required humidification amounts of habitable rooms 102 (step S124). In the second exemplary embodiment, the required air conditioning amount of general housing 101 is calculated based on the average value of the required humidification amounts of habitable rooms 102.

Next, controller 150 determines the operation of humidifier 116 (step S125). Specifically, when the required humidification amount of general housing 101 is positive (YES in step S125), controller 150 operates humidifier 116 and proceeds to step S126. When the required humidification amount of general housing 101 is 0 or negative (NO in step S125), controller 150 sets the rotation speed of water pumping pipe 137 to "0", does not operate humidifier 116 (step S128), and ends the humidifying control.

Subsequently, controller 150 specifies the required rotation speed of water pumping pipe 137 in accordance with the calculated required air conditioning amount of general housing 101, the inlet temperature of humidifier 116, and the total air volume of transfer fans 103 (step S126). In step S126, controller 150 sets the required rotation speed to be higher as the required humidification amount is higher, as the inlet temperature is lower, or as the total air volume of transfer fans 103 is smaller.

In the second exemplary embodiment, controller 150 specifies the required rotation speed based on humidification performance data of humidifier 116 illustrated in FIG. 15. The humidification performance data is data obtained in advance by an experiment, and indicates humidification amount X output from humidifier 116 when the humidifying action is performed under the conditions of the inlet temperature T, the rotation speed R of water pumping pipe 137, and the total air volume Q of transfer fans 103. Here, the humidification amount X output by humidifier 116 corresponds to the amount of moisture to be contained in the air flowing through humidifier 116. From the characteristics of humidifier 116, each of the inlet temperature T, the rotation speed R, and the total air volume Q has a positive correlation with the humidification amount X. For example, when the total air volume Q1 and the total air volume Q2 have a relationship of Q1<Q2, when the temperature T1 and the rotation speed R1 are assumed, the magnitude relationship between the humidification amount X1 and the humidification amount X2 is X1<X2.

Next, a method for specifying the required rotation speed from the humidification performance data will be described in detail. First, a regression formula related to the humidification amount X is created from the table data, and Formula (1) in FIG. 15 is obtained. Next, the created regression formula is transformed so that the rotation speed R is on the left side to obtain Formula (2) in FIG. 15. Then, the required rotation speed is derived by calculating the right side of Formula (2) with the inlet temperature from inlet temperature sensor 114 as the inlet temperature T, the total air volume of transfer fans 103 as the total air volume Q, and the required humidification amount X' of general housing 101 as the humidification amount X. Although the regression formula expressed in Formula (1) is a combination of first-order terms of the rotation speed R, the inlet temperature T, and the total air volume Q, any second-order or higher-order term of the rotation speed R, the inlet temperature T, and the total air volume Q may be included in order to improve the regression accuracy.

Subsequently, controller 150 specifies the upper limit rotation speed as the rotation speed of water pumping pipe 137 when the required rotation speed exceeds a preset upper limit rotation speed, and specifies the lower limit rotation speed as the rotation speed of water pumping pipe 137 when the required rotation speed falls below a preset lower limit rotation speed (step S127).

As a result, when the total air volume Q of transfer fans 103 increases in a state where the required humidification amount X' and the inlet temperature T are constant, the control to decrease the rotation speed R of water pumping pipe 137 is performed, thus the humidification amount to be contained in the air transferred to each habitable room 102 decreases. Similarly, when the total air volume Q of transfer fans 103 decreases with the required humidification amount X' and the inlet temperature T being constant, the control to increase the rotation speed R of water pumping pipe 137 is performed, thus the humidification amount to be contained in the air transported to each habitable room 102 increases. That is, even when the total air volume Q of transfer fans 103 fluctuates and the transferring volume of the air to be transferred to each habitable room 102 fluctuates, the humidification amount included in the air to be transferred to each habitable room 102 is adjusted according to the fluctuation of the total air volume Q of transfer fans 103, thus the fluctuation of the moisture amount supplied to each classroom 2 is suppressed.

Here, when the required rotation speed exceeds the upper limit rotation speed, it means that the humidification amount that can be output at the upper limit rotation speed is insufficient with respect to the required humidification amount. When the required rotation speed is lower than the lower limit rotation speed, it means that the humidification amount that can be output at the lower limit rotation speed is excessive with respect to the required humidification amount.

Next, a method for eliminating excess or deficiency of the humidification amount by adjusting the total air volume Q of transfer fans 103 or adjusting the opening degree of inlet damper 115 in these cases will be described.

Figure 16:
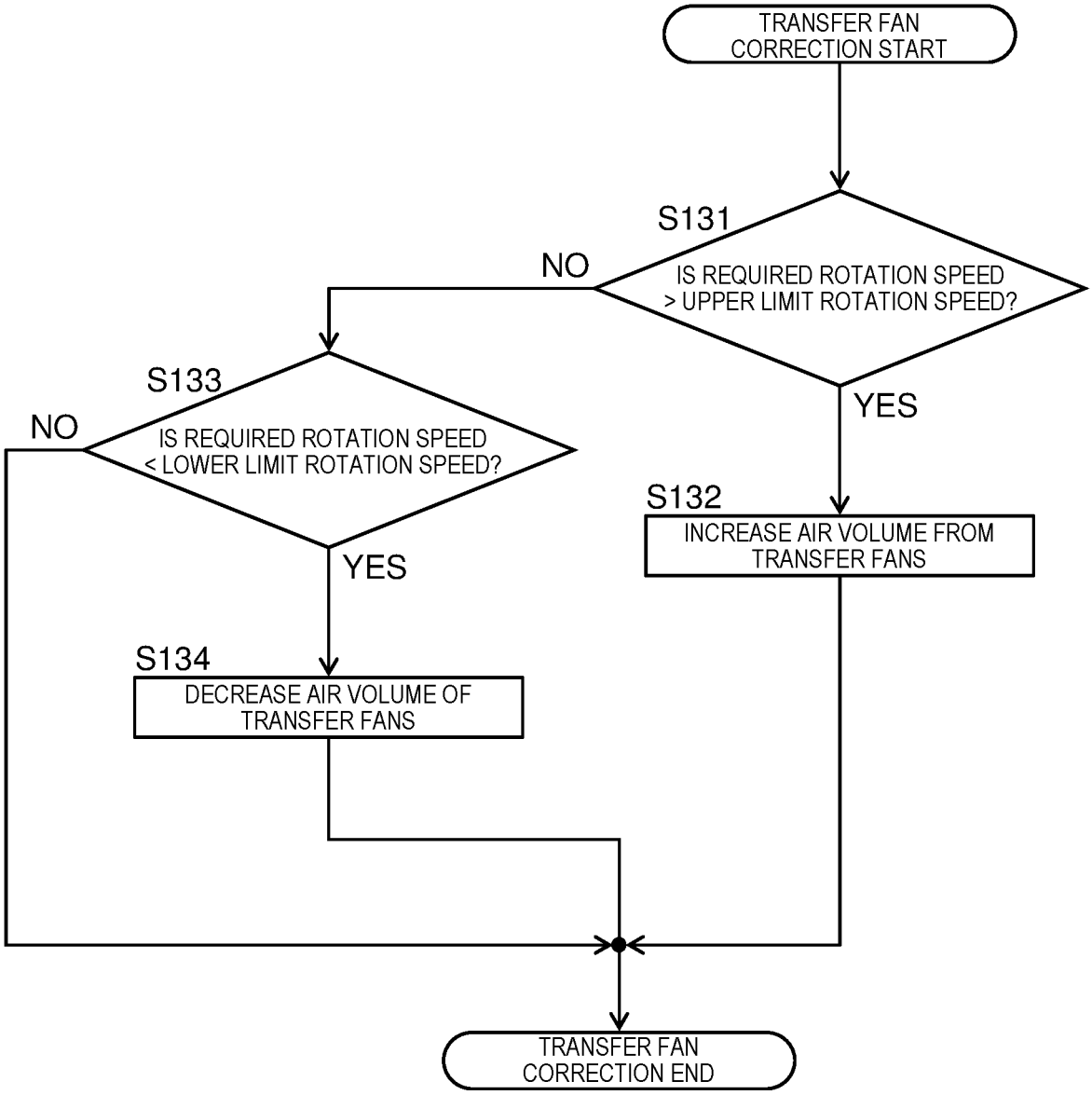
FIG. 16 is a flowchart illustrating a transfer fan air volume correction process of the controller.

First, with reference to FIG. 16, the processing operation when the air volume of transfer fans 103 is corrected in the humidifying control will be described. FIG. 16 is a flowchart illustrating a transfer fan air volume correction process of controller 150.

First, when the required rotation speed exceeds the upper limit rotation speed (YES in step S131), controller 150 increases the total air volume Q of transfer fans 103 by a predetermined ratio (for example, 1.1 times) (step S132). When the required rotation speed is less than or equal to the upper limit rotation speed (NO in step S131), it is determined whether the required rotation speed is lower than the lower limit rotation speed (step S133). When the required rotation speed is lower than the lower limit rotation speed (YES in step S133), the total air volume Q of transfer fans 103 is decreased by the predetermined ratio (for example, 0.9 times) (step S134). In the second exemplary embodiment, since the total air volume Q of transfer fans 103 is set to be equal to the blown air volume of air conditioner 113, the blown air volume of air conditioner 113 is increased or decreased to be equal to the total air volume of transfer fans 103 in accordance with correction of the air volume of transfer fans 103. As a result, the volume of the air flowing into humidifier 116 can be changed without changing the temperature of the air sucked into humidifier 116. As a result, when the humidification amount that can be output at the upper limit rotation speed is below the required humidification amount, the transferring amount of the air transferred to each habitable room 102 increases. When the humidification amount that can be output at the lower limit rotation speed is larger than the required humidification amount, the transferring amount of the air transferred to each habitable room 102 decreases. The corrected total air volume Q of transfer fans 103 may be specified by solving Formula (1) for the total air volume Q, and calculating the total air volume Q by substituting the required humidification amount of general housing 101 as the humidification amount X, the upper limit rotation speed as the rotation speed R, and the inlet temperature from inlet temperature sensor 114 as the inlet temperature T.

Figure 17:
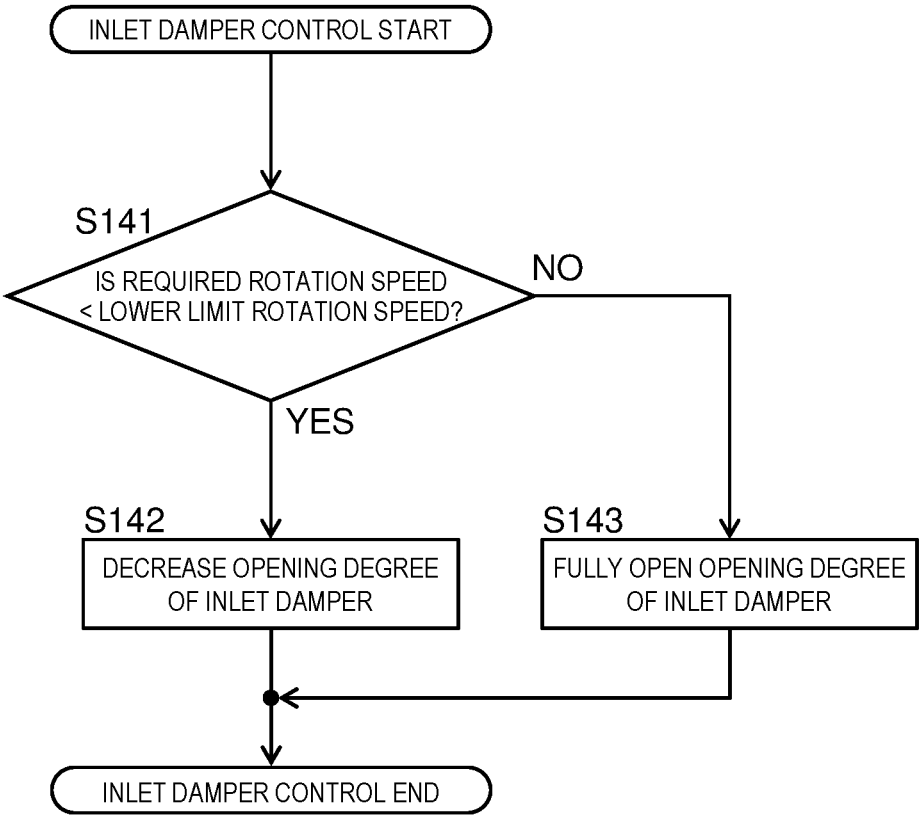
FIG. 17 is a flowchart illustrating a control operation of an inlet damper by the controller.

Next, the control of inlet damper 115 will be described with reference to FIG. 17. FIG. 17 is a flowchart illustrating a control operation of an inlet damper by controller 150.

First, controller 150 determines whether the required rotation speed is lower than the lower limit rotation speed (step S141). Then, when the required rotation speed is lower than the lower limit rotation speed (YES in step S141) according to the result of the determination, the opening degree of inlet damper 115 is decreased to, for example, the opening degree "50%" (step S142), and the inflow air volume into humidifier 116 is decreased. On the other hand, when the required rotation speed is higher than or equal to the lower limit rotation speed (NO in step S141) according to the result of the determination, the opening degree of inlet damper 115 is set to "100%" (step S143) so as not to obstruct the air flowing into humidifier 116. As a result, when the required rotation speed is lower than the lower limit rotation speed, the opening degree of inlet damper 115 decreases, thus the volume of air flowing into humidifier 116 decreases, and the humidification amount contained in the air to be transferred to each habitable room 102 further decreases.

Air conditioning system 120 according to the second exemplary embodiment described above can produce the following effects.

(1) Air conditioning system 120 includes: air conditioning room 118 configured to introduce air from outside; air conditioner 113 disposed in air conditioning room 118 and adjusting temperature of air in air conditioning room 118; humidifier 116 disposed in air conditioning room 118 and humidifying air temperature-adjusted by air conditioner 113; a plurality of transfer fans 103 transferring air in air conditioning room 118 to a plurality of habitable rooms 102 independent of air conditioning room 118; and controller 150 controlling humidifier 116 and transfer fans 103. Humidifier 116 is configured to centrifugally crush and micronize the water pumped by the rotation of water pumping pipe 137, and release the water contained in the air temperature-controlled by air conditioner 113. Controller 150 specifies the rotation speed of water pumping pipe 137 (rotary motor 134) based on the required humidification amount of habitable room 102, the temperature of the air temperature-controlled by air conditioner 113, and the air volume of transfer fans 103, and controls the humidification amounts to the air temperature-controlled by air conditioner 113 based on the specified rotation speed.

As a result, even in the case where the transferring amount of the air transferred to each habitable room 102 fluctuates, the humidification amount contained in the air to be transferred to each habitable room 102 is adjusted according to the fluctuation, thus the fluctuation of the moisture amount supplied to each classroom 2 is suppressed, and the humidity of the air in each habitable room 102 can be stably maintained at the target humidity. That is, it is possible to provide air conditioning system 120 capable of performing humidifying control by humidifier 116 corresponding to the air volume fluctuation of transfer fans 103.

(2) In air conditioning system 120, controller 150 executes control to decrease the rotation speed of water pumping pipe 137 when the air volume of transfer fans 103 increases, and execute control to increase the rotation speed of water pumping pipe 137 when the air volume of transfer fans 103 decreases. As a result, when the air volume of transfer fans 103 increases, the humidification amount contained in the air to be transferred to each habitable room 102 decreases, and when the air volume of transfer fans 103 decreases, the humidification amount contained in the air to be transferred to each habitable room 102 increases, thus it is possible to suppress the fluctuation in the moisture amount supplied to each habitable room 102 due to the fluctuation in the air volume of transfer fans 103.

(3) In air conditioning system 120, water pumping pipe 137 is rotatable within a range between the lower limit rotation speed and the upper limit rotation speed, and controller 150 executes control to increase the air volume of transfer fans 103 when the humidification amount that can be output at the upper limit rotation speed is less than the required humidification amount, and executes control to decrease the air volume of transfer fans 103 when the humidification amount that can be output at the lower limit rotation speed is more than the required humidification amount. As a result, when the humidification amount that can be output at the upper limit rotation speed is below the required humidification amount, the transferring amount of the air to be transferred to each habitable room 102 increases, thus the moisture amount supplied to each habitable room 102 can be increased. On the other hand, when the humidification amount that can be output at the lower limit rotation speed is larger than the required humidification amount, the transferring amount of the air to be transferred to each habitable room 102 decreases, thus the moisture amount supplied to each habitable room 102 can be reduced. That is, in air conditioning system 120, the adjustable range of the humidification amount by humidifier 116 is widened, and highly accurate humidification adjustment can be performed on the air whose temperature has been adjusted by air conditioner 113.

(4) Air conditioning system 120 further includes inlet damper 115 that adjusts an inflow air volume into humidifier 116, and controller 150 is configured to be able to control inlet damper 115 and executes control to decrease the inflow air volume by inlet damper 115 when the humidification amount that can be output at the lower limit rotation speed exceeds the requested humidification amount. As a result, when the humidification amount that can be output at the lower limit rotation speed is larger than the required humidification amount, the humidification amount contained in the air to be transferred to each habitable room 102 is further reduced, thus the moisture amount supplied to each habitable room 102 can be further reduced.

The present disclosure has been described above based on the second exemplary embodiment. It will be understood by those skilled in the art that the second exemplary embodiment is merely an example; further, in modifications of the exemplary embodiment, components or processes of the exemplary embodiment are variously combined, and additionally, the modifications fall within the scope of the present disclosure.

INDUSTRIAL APPLICABILITY

The air conditioning system according to the present disclosure is useful as being capable of stably performing humidification by the humidifier even when humidity affected by disturbance is detected in the air-conditioned space.

REFERENCE MARKS IN THE DRAWINGS

1: general housing
2, 2*a*, 2*b*, 2*c*, 2*d*: habitable room
3, 3*a*, 3*b*: transfer fan
4: heat exchange ventilation fan
5, 5*a*, 5*b*, 5*c*, 5*d*: habitable room damper
6, 6*a*, 6*b*, 6*c*, 6*d*: circulation port
7, 7*a*, 7*b*, 7*c*, 7*d*: habitable room exhaust port
8, 8*a*, 8*b*, 8*c*, 8*d*: habitable room air supply port
11, 11*a*, 11*b*, 11*c*, 11*d*: habitable room temperature sensor
12, 12*a*, 12*b*, 12*c*, 12*d*: habitable room humidity sensor
13: air conditioner
14: inlet temperature sensor
16: humidifier
17: dust collection filter
18: air conditioning room
20: air conditioning system
31: inlet
32: outlet
33: liquid atomization chamber
34: rotary motor
35: rotary shaft
36: centrifugal fan
37: water pumping pipe
38: rotary plate
39: opening
40: water storage
41: first eliminator
42: second eliminator
50: controller
50*a*: operation panel
50*b*: input unit
50*c*: processor
50*d*: storage
50*e*: timer
50*f*: damper opening specifying unit
50*g*: air volume specifying unit
50*h*: set temperature specifying unit
50*i*: output unit
50*j*: display panel
50*k*: rotation speed specifying unit
101: general housing
102, 102*a*, 102*b*, 102*c*, 102*d*: habitable room
103, 103*a*, 103*b*: transfer fan
104: heat exchange ventilation fan
105, 105*a*, 105*b*, 105*c*, 105*d*: habitable room damper
106, 106*a*, 106*b*, 106*c*, 106*d*: circulation port
107, 107*a*, 107*b*, 107*c*, 107*d*: habitable room exhaust port
108, 108*a*, 108*b*, 108*c*, 108*d*: habitable room air supply port
111, 111*a*, 111*b*, 111*c*, 111*d*: habitable room temperature sensor
112, 112*a*, 112*b*, 112*c*, 112*d*: habitable room humidity sensor
113: air conditioner
114: inlet temperature sensor
115: inlet damper
116: humidifier
117: dust collection filter
118: air conditioning room
120: air conditioning system
131: inlet

132: outlet
133: liquid atomization chamber
134: rotary motor
135: rotary shaft
136: centrifugal fan
137: water pumping pipe
138: rotary plate
139: opening
140: water storage
141: first eliminator
142: second eliminator
150: controller
150*a*: operation panel
150*b*: input unit
150*c*: processor
150*d*: storage
150*e*: timer
150*f*: damper opening specifying unit
150*g*: air volume specifying unit
150*h*: set temperature specifying unit
150*i*: output unit
150*j*: display panel
150*k*: rotation speed specifying unit

The invention claimed is:

1. An air conditioning system comprising:

an air conditioning room configured to introduce air from outside;

an air conditioner disposed in the air conditioning room and adjusting temperature of the air in the air conditioning room;

a humidifier disposed in the air conditioning room and humidifying the air temperature-adjusted by the air conditioner;

a plurality of transfer fans transferring the air in the air conditioning room to a plurality of air-conditioned spaces independent of the air conditioning room, respectively; and a controller controlling the humidifier, wherein the controller:

acquires, as a first humidity, information related to detected humidity of the air detected in each of the plurality of air-conditioned spaces, causes the humidifier to execute a first humidifying control based on an average value of respective first humidities in the plurality of the air-conditioned spaces;

in response to elapse of a predetermined time after causing the humidifier to execute a first humidifying control, acquires, as a second humidity, information related to detected humidity of the air detected in each of the plurality of air-conditioned spaces; and causes the humidifier to switch to and execute a second humidifying control based on an average value of respective second humidities in the plurality of the air-conditioned spaces in the case of a first humidity difference between the second humidity in one air-conditioned space of the plurality of the air-conditioned spaces and the average value of the respective second humidities in the plurality of the air-conditioned spaces being less than or equal to a first threshold value, and causes the humidifier to continue to execute the first humidifying control in the case of the first humidity difference being more than the first threshold value.

2. The air conditioning system according to claim 1, wherein the controller causes the humidifier to switch to and execute the second humidifying control instead of the first humidifying control when the first humidity difference is more than the first threshold value and the detected humidity changes from the second humidity to a third humidity differing from the second humidity and in the case of a fourth second humidity difference between the second humidity and the third humidity being less than or equal to a second threshold value.

* * * * *